US007577266B2

(12) United States Patent
Feng et al.

(10) Patent No.: US 7,577,266 B2
(45) **Date of Patent: *Aug. 18, 2009**

(54) SYSTEMS AND METHODS FOR INTERFERENCE SUPPRESSION WITH DIRECTIONAL SENSING PATTERNS

(75) Inventors: Albert S. Feng, Champaign, IL (US); Michael E. Lockwood, Champaign, IL (US); Douglas L. Jones, Champaign, IL (US); Robert C. Bilger, Champaign, IL (US); Carolyn J. Bilger, legal representative, Champaign, IL (US); Charissa R. Lansing, Champaign, IL (US); William D. O'Brien, Champaign, IL (US); Bruce C. Wheeler, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 21 days.

This patent is subject to a terminal disclaimer.

(21) Appl. No.: 11/484,838

(22) Filed: Jul. 11, 2006

(65) Prior Publication Data

US 2007/0127753 A1 Jun. 7, 2007

Related U.S. Application Data

(63) Continuation of application No. 10/409,969, filed on Apr. 9, 2003, now Pat. No. 7,076,072.

(51) Int. Cl.
*H04R 25/00* (2006.01)
*H04R 3/00* (2006.01)
*H04R 11/04* (2006.01)

(52) U.S. Cl. ..... 381/313; 381/92; 381/356

(58) Field of Classification Search ..... 381/23.1, 381/92, 312, 313, 320, 321, 356, 357, 358
See application file for complete search history.

(56) References Cited

U.S. PATENT DOCUMENTS 3,123,678 A 3/1964 Prentiss et al.

(Continued)

FOREIGN PATENT DOCUMENTS

DE 28 23 798 B1 9/1979

(Continued)

OTHER PUBLICATIONS

Van Veen, Barry, et al., Beamforming: A Versatile Approach to Spatial Filtering, IEEE ASSP Magazine, Apr. 1988, IEEE*.

(Continued)

*Primary Examiner*—Brian Ensey
(74) *Attorney, Agent, or Firm*—Krieg DeVault LLP

(57) ABSTRACT

System (10) is disclosed including an acoustic sensor array (20) coupled to processor (42). System (10) processes inputs from array (20) to extract a desired acoustic signal through the suppression of interfering signals. The extraction/suppression is performed by modifying the array (20) inputs in the frequency domain with weights selected to minimize variance of the resulting output signal while maintaining unity gain of signals received in the direction of the desired acoustic signal. System (10) may be utilized in hearing, cochlear implants, speech recognition, voice input devices, surveillance devices, hands-free telephony devices, remote telepresence or teleconferencing, wireless acoustic sensor arrays, and other applications.

28 Claims, 10 Drawing Sheets

U.S. PATENT DOCUMENTS 4,025,721 A 5/1977 Graupe et al.
4,207,441 A 6/1980 Ricard et al.
4,267,580 A 5/1981 Bond et al.
4,304,235 A 12/1981 Kaufman
4,354,064 A 10/1982 Scott
4,559,642 A 12/1985 Miyaji et al.
4,601,025 A 7/1986 Lea
4,611,598 A 9/1986 Hortmann et al.
4,703,506 A 10/1987 Sakamoto et al.
4,742,548 A 5/1988 Sessler et al.
4,752,961 A 6/1988 Kahn
4,773,095 A 9/1988 Zwicker et al.
4,790,019 A 12/1988 Hueber
4,845,755 A 7/1989 Busch et al.
4,858,612 A 8/1989 Stocklin
4,918,737 A 4/1990 Luethi
4,982,434 A 1/1991 Lenhardt et al.
4,987,897 A 1/1991 Funke
4,988,981 A 1/1991 Zimmerman et al.
5,012,520 A 4/1991 Steeger
5,029,216 A 7/1991 Jhabvala et al.
5,040,156 A 8/1991 Foller
5,047,994 A 9/1991 Lenhardt et al.
5,113,859 A 5/1992 Funke
5,245,556 A 9/1993 Morgan et al.
5,259,032 A 11/1993 Perkins et al.
5,285,499 A 2/1994 Shannon et al.
5,289,544 A 2/1994 Franklin
5,321,332 A 6/1994 Toda
5,325,436 A 6/1994 Soli et al.
5,383,164 A 1/1995 Sejnowski et al.
5,383,915 A 1/1995 Adams
5,400,409 A 3/1995 Linhard
5,417,113 A 5/1995 Hartley
5,430,690 A 7/1995 Abel
5,454,838 A 10/1995 Vallana et al.
5,463,694 A 10/1995 Bradley et al.
5,473,701 A * 12/1995 Cezanne et al. ..... 381/92
5,479,522 A 12/1995 Lindemann et al.
5,485,515 A 1/1996 Allen et al.
5,495,534 A 2/1996 Inanaga et al.
5,507,781 A 4/1996 Kroll et al.
5,511,128 A 4/1996 Lindemann
5,581,620 A 12/1996 Brandstein et al.
5,627,799 A 5/1997 Hoshuyama
5,651,071 A 7/1997 Lindemann et al.
5,663,727 A 9/1997 Vokac
5,694,474 A 12/1997 Ngo et al.
5,706,352 A 1/1998 Engebretson et al.
5,721,783 A 2/1998 Anderson
5,734,976 A 3/1998 Bartschi et al.
5,737,430 A 4/1998 Widrow
5,755,748 A 5/1998 Borza
5,757,932 A 5/1998 Lindemann et al.
5,768,392 A 6/1998 Graupe
5,787,183 A 7/1998 Chu et al.
5,793,875 A 8/1998 Lehr et al.
5,814,095 A 9/1998 Muller et al.
5,825,898 A 10/1998 Marash
5,831,936 A 11/1998 Zlotnick et al.
5,833,603 A 11/1998 Kovacs et al.
5,878,147 A 3/1999 Killion et al.
5,889,870 A 3/1999 Norris
5,991,419 A 11/1999 Brander
6,002,776 A 12/1999 Bhadkamkar et al.
6,009,183 A 12/1999 Taenzer et al.
6,010,532 A 1/2000 Kroll et al.
6,023,514 A 2/2000 Strandberg
6,068,589 A 5/2000 Neukermans
6,094,150 A 7/2000 Ohnishi et al.
6,104,822 A 8/2000 Melanson et al.
6,118,882 A 9/2000 Haynes
6,137,889 A 10/2000 Shennib et al.
6,141,591 A 10/2000 Lenarz et al.
6,154,552 A 11/2000 Koroljow et al.
6,160,757 A 12/2000 Tager et al.
6,161,046 A 12/2000 Maniglia et al.
6,167,312 A 12/2000 Goedeke
6,173,062 B1 1/2001 Dibachi et al.
6,182,018 B1 1/2001 Tran et al.
6,192,134 B1 2/2001 White et al.
6,198,693 B1 3/2001 Marash
6,198,971 B1 3/2001 Leysieffer
6,217,508 B1 4/2001 Ball et al.
6,222,927 B1 4/2001 Feng et al.
6,223,018 B1 4/2001 Fukumoto et al.
6,229,900 B1 5/2001 Leenen
6,243,471 B1 6/2001 Brandstein et al.
6,251,062 B1 6/2001 Leysieffer
6,261,224 B1 7/2001 Adams et al.
6,272,229 B1 8/2001 Baekgaard
6,283,915 B1 9/2001 Aceti et al.
6,307,945 B1 10/2001 Hall
6,317,703 B1 11/2001 Linsker
6,334,072 B1 12/2001 Leysieffer
6,342,035 B1 1/2002 Kroll et al.
6,363,139 B1 3/2002 Zurek et al.
6,380,896 B1 4/2002 Berger et al.
6,390,971 B1 5/2002 Adams et al.
6,603,861 B1 * 8/2003 Maisano et al. ..... 381/92
6,751,325 B1 6/2004 Fischer
6,778,674 B1 8/2004 Panasik et al.
2001/0049466 A1 12/2001 Leysieffer et al.
2001/0051776 A1 12/2001 Lenhardt
2002/0012438 A1 1/2002 Leysieffer et al.
2002/0019668 A1 2/2002 Stockert et al.
2002/0029070 A1 3/2002 Leysieffer et al.
2003/0061032 A1 3/2003 Gonopolskiy
2003/0215106 A1 * 11/2003 Hagen et al. ..... 381/313

FOREIGN PATENT DOCUMENTS

DE 33 22 108 A1 12/1984
DE 195 41 648 C2 10/2000
DE 100 40 660 A1 2/2001
EP 0 824 889 A1 2/1998
EP 0 802 699 A2 10/1998
WO WO 98/26629 6/1998
WO WO 98/56459 12/1998
WO WO 00/30404 5/2000
WO WO 00/33634 6/2000
WO WO 01/06851 A1 2/2001
WO WO 01/87011 A2 11/2001
WO WO 01/87014 A2 11/2001

OTHER PUBLICATIONS

Frost, O., "An Algorithm for Linearly Constrained Adaptive Array Processing," Stanford University, Sanford, CA (Aug. 1972)*.

Stadler, et al., "On the Potential of Fixed Arrays for Hearings Aids," J. Acoust. Soc., Am 94 (3), Pt. 1, (Sep. 1993)*.

Soede, et al., "Development of a Directional Hearing Instrument Based on Array Technology," J. Acoust. Soc., Am. 94 (2), Pt. 1 (Aug. 1993)*.

Bodden, M., "Auditory Demonstrations of a Cocktail-Party-Processor" Acta Acustica vol. 82, (1996)*.

Whitman, et al., "Reducing Correlated Noise in Digital Hearing Aids," IEEE Engineering in Medicine and Biology (Sep./Oct. 1996)*.

Banks, D., "Localization and Separation of Simultaneous Voices with Two Microphones" IEEE (1993)*.

Bodden, "Modeling Human Sound-Source Localization and the Cocktail-Party-Effect" Acta Acustica, vol. 1 (Feb./Apr. 1993)*.

Griffiths, J., "An Alternative Approach to Linearly Constrained Adaptive Beamforming" IEEE Transactions on Antennas and Propagation, V. AP-30, No. 1, (Jan. 1982)*.
Lindemann, "Extension of a Binaural Cross-Correlation Model by Contralateral Inhibition, I. Simulation of Lateralization for Stationary Signals" J. Acous. Soc. Am. 80(6) '96*.
Link, et al., "Prewhitening for Intelligibility Gain in Hearing Aid Arrays" J. Acous. Soc. Am. 93 (4), Pt. 1, (Apr. 1993)*.
Hoffman, et al., "Robust Adaptive Microphone Array Processing for Hearing Aids: Realistic Speech Enhancement" J. Acoust. Soc. Am. 96 (2), Pt. 1, (Aug. 1994)*.
Peissig, "Directivity of Binaural Noise Reduction in Spatial Multiple Noise-Source Arrangements for Normal and Impaired Listeners" J. Acoust. Soc. Am. 101 (3) (Mar. 1997)*.
Capon "High-Resolution Frequency-Wavenumber Spectrum Analysis" Proceedings of the IEEE, vol. 57, No. 8 (Aug. 1969)*.
Kollmeier, et al., "Real-Time Multiband Dynamic Compression and Noise Reduction for Binaural Hearing Aids" Jour. Rehabilitation Research and Development, vol. 30, No. 1, '93*.
McDonough "Application of the Maximum-Likelihood Method and the Maximum-Entropy Method to Array Processing" Tpics in Applied Physics, vol. 34*.
Zimmerman, T.G., "Personal Area Networks: Near-field Intrabody Communication" (1996)*.
Liu, et al., "Localization of Mulitple Sound Sources with Two Microphones," J. Acoustical Society of America 108 (4), Oct. 2000*.

* cited by examiner

SYSTEMS AND METHODS FOR INTERFERENCE SUPPRESSION WITH DIRECTIONAL SENSING PATTERNS

CROSS-REFERENCE TO RELATED APPLICATIONS

The present application is a continuation of U.S. Patent Application No. 10/409,969 filed on Apr. 9, 2003 now U.S. Pat. No. 7,076,072 and incorporated herein by reference. The present application is related to International Patent Application Number PCT/US-01/15047 filed on May 10, 2001; International Patent Application Number PCT/US01/14945 filed on May 9, 2001; U.S. patent application Ser. No. 09/805,233 filed on Mar. 13, 2001; U.S. patent application Ser. No. 09/568,435 filed on May 10, 2000; U.S. patent application Ser. No. 09/568,430 filed on May 10, 2000; International Patent Application Number PCT/US99/26965 filed on Nov. 16, 1999; and U.S. Pat. No. 6,222,927 B1; all of which are incorporated herein by reference.

GOVERNMENT RIGHTS

This invention was made with government support under Contract Number 240-67628 awarded by DARPA. The government has certain rights in this invention.

The present invention is directed to the processing of signals, and more particularly, but not exclusively, relates to techniques to extract a signal from a selected source while suppressing interference from one or more other sources using two or more microphones.

The difficulty of extracting a desired signal in the presence of interfering signals is a long-standing problem confronted by engineers. This problem impacts the design and construction of many kinds of devices such as acoustic-based systems for interrogation, detection, speech recognition, hearing assistance or enhancement, and/or intelligence gathering. Generally, such devices do not permit the selective amplification of a desired sound when contaminated by noise from a nearby source. This problem is even more severe when the desired sound is a speech signal and the nearby noise is also a speech signal produced by other talkers. As used herein, "noise" refers not only to random or nondeterministic signals, but also to undesired signals and signals interfering with the perception of a desired signal.

SUMMARY OF THE INVENTION

One form of the present invention includes a unique signal processing technique using two or more detectors. Other forms include unique devices and methods for processing signals.

A further embodiment of the present invention includes a system with a number of directional sensors and a processor operable to execute a beamforming routine with signals received from the sensors. The processor is further operable to provide an output signal representative of a property of a selected source detected with the sensors. The beamforming routine may be of a fixed or adaptive type.

In another embodiment, an arrangement includes a number of sensors each responsive to detected sound to provide a corresponding number of representative signals. These sensors each have a directional reception pattern with a maximum response direction and a minimum response direction that differ in relative sound reception level by at least 3 decibels at a selected frequency. A first axis coincident with the maximum response direction of a first one of the sensors intersects a second axis coincident with the maximum response direction of a second one of those signals at an angle in a range of about 10 degrees through about 180 degrees. A processor is also included that is operable to execute a beamforming routine with the sensor signals and generate an output signal represeritative of a selected sound source. An output device may be included that responds to this output signal to provide an output representative of sound from the selected source. In one form, the sensors, processor, and output device belong to a hearing system.

Still another embodiment includes: providing a number of directional sensors each operable to detect sound and provide a corresponding number of sensor signals. The sensors each have a directional response pattern oriented in a predefined positional relationship with respect to one another. The sensor signals are processed with a number of signal weights that are adaptively recalculated from time-to-time. An output is provided based on this processing that represents sound emanating from a selected source.

Yet another embodiment includes a number of sensors oriented in relation to a reference axis and operable to provide a number of sensor signals representative of sound. The sensors each have a directional response pattern with a maximum response direction, and are arranged in a predefined positional relationship relative to one another with a separation distance of less than two centimeters to reduce a difference in time of reception between the sensors for sound emanating from a source closer to one of the sensors than another of the sensors. The processor generates an output signal from the sensor signals as a function of a number of signal weights for each of a number of different frequencies. The signal weights are adaptively recalculated from time-to-time.

Still a further embodiment of the present invention includes: positioning a number of directional sensors in a predefined geometry relative to one another that each have a directional pattern with sound response being attenuated by at least 3 decibels from one direction relative to another direction at a selected frequency; detecting acoustic excitation with the sensors to provide a corresponding number of sensor signals; establishing a number of frequency domain components for each of the sensor signals; and determining an output signal representative of the acoustic excitation from a designated direction. This determination can include weighting the components for each of the sensor signals to reduce variance of the output signals and provide a predefined gain of the acoustic excitation from the designated direction.

Further embodiments, objects, features, aspects, benefits, forms, and advantages of the present invention shall become apparent from the detailed drawings and descriptions provided herein.

DESCRIPTION OF SELECTED EMBODIMENTS

Figure 1:
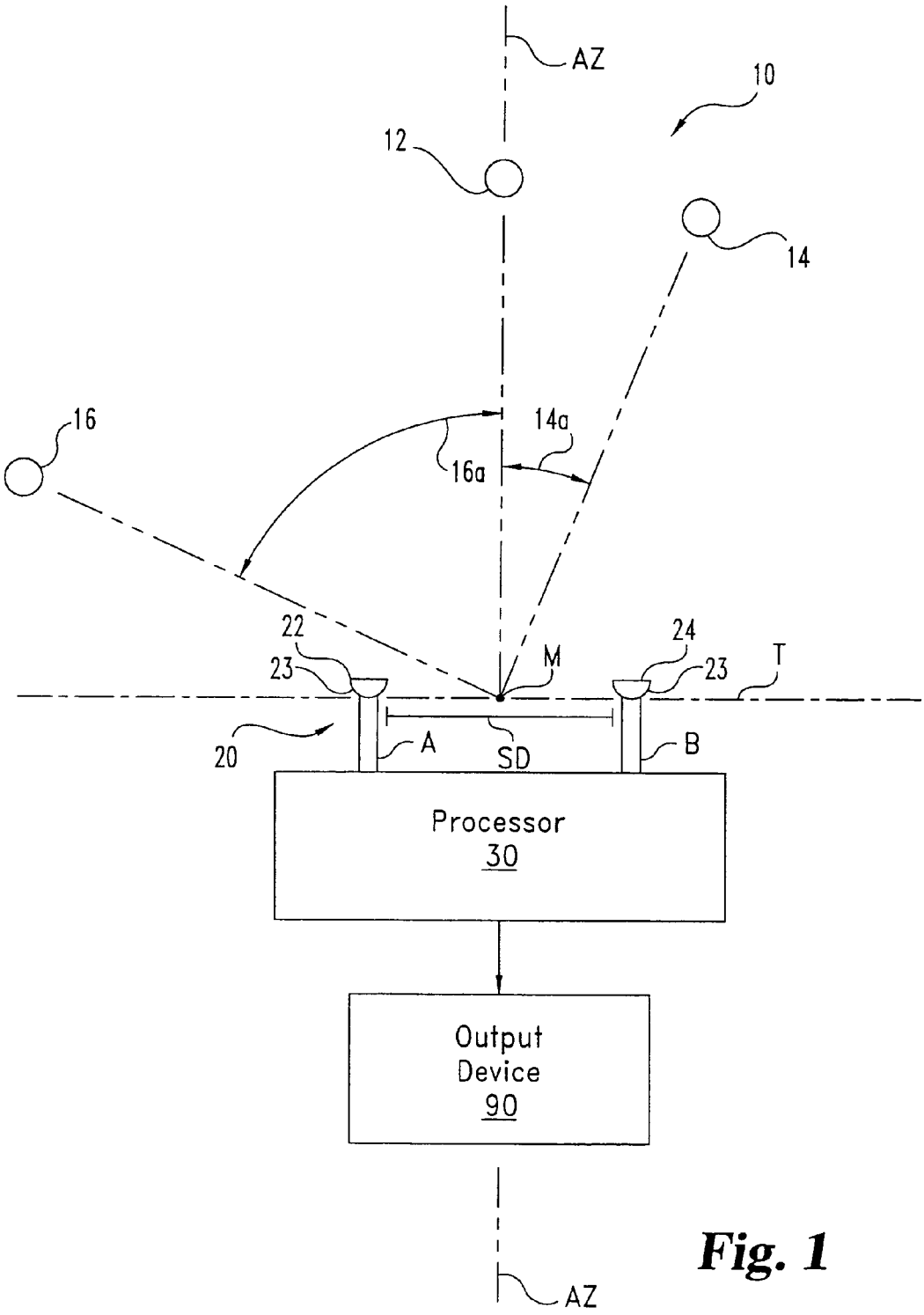
FIG. 1 is a diagrammatic view of a signal processing system.

While the present invention can take many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments, and any further applications of the principles of the invention as described herein are contemplated as would normally occur to one skilled in the art to which the invention relates.

FIG. 1 illustrates an acoustic signal processing system 10 of one embodiment of the present invention. System 10 is configured to extract a desired acoustic excitation from acoustic source 12 in the presence of interference or noise from other sources, such as acoustic sources 14, 16. System 10 includes acoustic sensor array 20. For the example illustrated, sensor array 20 includes a pair of acoustic sensors 22, 24 within the reception range of sources 12, 14, 16. Acoustic sensors 22, 24 are arranged to detect acoustic excitation from sources 12, 14, 16.

Sensors 22, 24 are separated by distance D as illustrated by the like labeled line segment along lateral axis T. Lateral axis T is perpendicular to azimuthal axis AZ. Midpoint M represents the halfway point along separation distance SD between sensor 22 and sensor 24. Axis AZ intersects midpoint M and acoustic source 12. Axis AZ is designated as a point of reference for sources 12, 14, 16 in the azimuthal plane and for sensors 22, 24. For the depicted embodiment, sources 14, 16 define azimuthal angles 14a, 16a relative to axis AZ of about +22 and −65°, respectively. Correspondingly, acoustic source 12 is at 0° relative to axis AZ. In one mode of operation of system 10, the "on axis" alignment of acoustic source 12 with axis AZ selects it as a desired or target source of acoustic excitation to be monitored with system 10. In contrast, the "off-axis" sources 14, 16 are treated as noise and suppressed by system 10, which is explained in more detail hereinafter. To adjust the direction being monitored, sensors 22, 24 can be steered to change the position of axis AZ. In an additional or alternative operating mode, the designated monitoring direction can be adjusted as more fully described below. For these operating modes, it should be understood that neither sensor 22 nor 24 needs to be moved to change the designated monitoring direction, and the designated monitoring direction need not be coincident with axis AZ.

Figure 2:
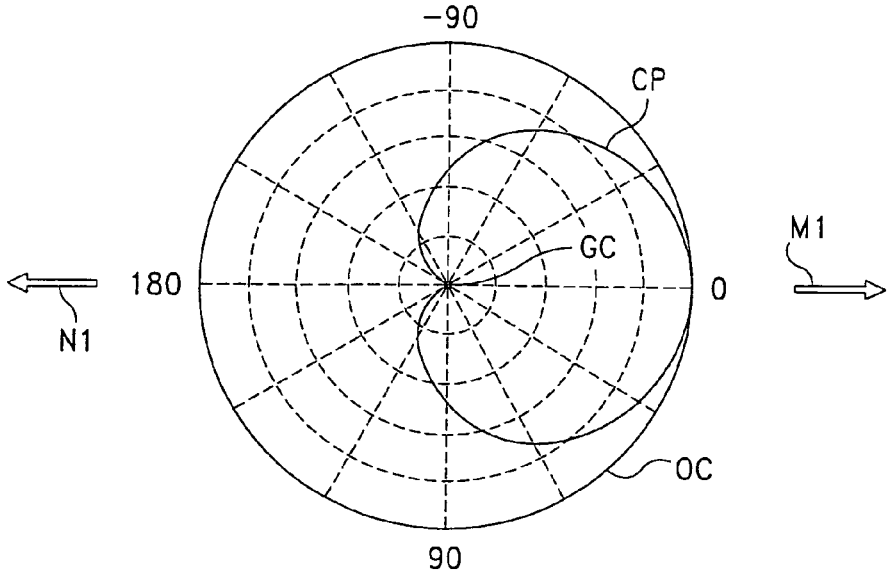
FIG. 2 is a graph of a polar directional response pattern of a cardioid type microphone.

Sensors 22, 24 are of a directional type and are illustrated in the form of microphones 23 each having a type of directional sound-sensing pattern with a maximum response direction. A few nonlimiting types of such directional patterns are illustrated in FIGS. 2-5. FIG. 2 is a graph of a directional response pattern CP of a cardioid type in polar format. The heart shape of pattern CP has a minimum response along the direction indicated by arrow N1 (the 180 degree position) and a maximum response along the direction indicated by arrow Ml (the zero degree position). Correspondingly, the intersection of pattern CP with outer circle OC represents the greatest relative response level. The concentric circles of the FIG. 2 graph represent successively decreasing response levels as the graph center GC is approached, such that intersection of pattern CP with these lines represent response levels between the minimum and maximum extremes. The intersection of pattern CP with center GC corresponds to the minimum response level. In one form, each of the concentric levels represents a uniform amount of change in decibels (being logorithmic in absolute terms). In other forms, different scales and/or response level units can apply. In contrast to pattern CP, an omnidirectional microphone has a generally circular pattern corresponding, for instance, to the outer circle OC of the FIG. 2 graph.

Figure 3:
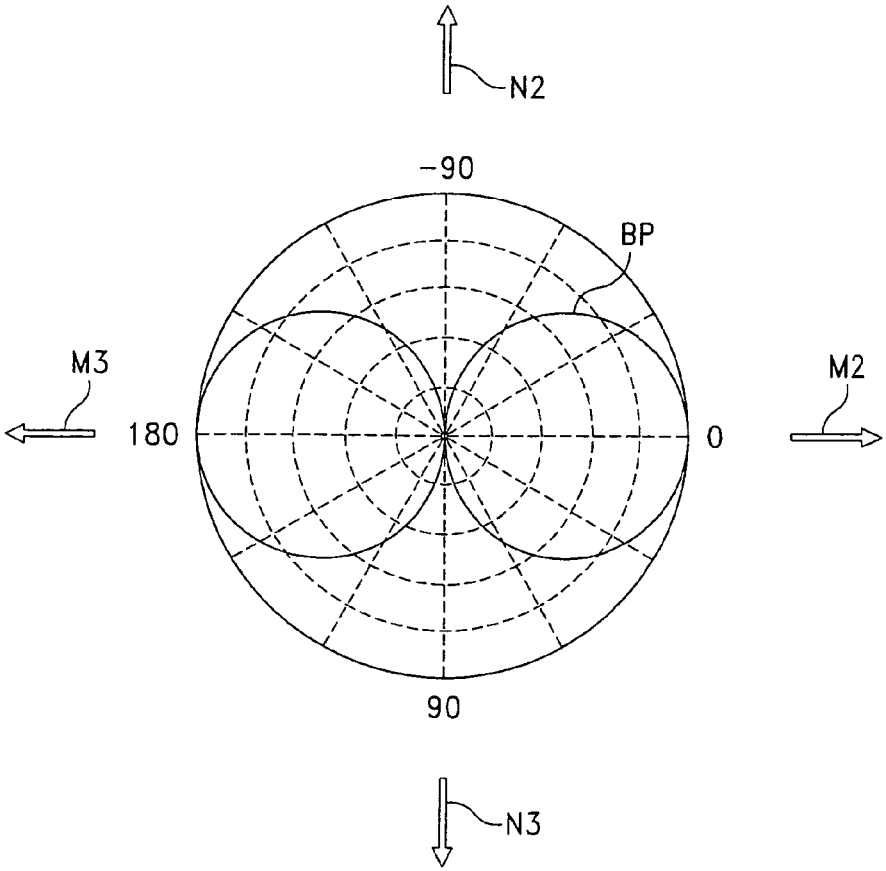
FIG. 3 is a graph of a polar directional response pattern of a pressure gradient figure-8 type microphone.
Figure 4:
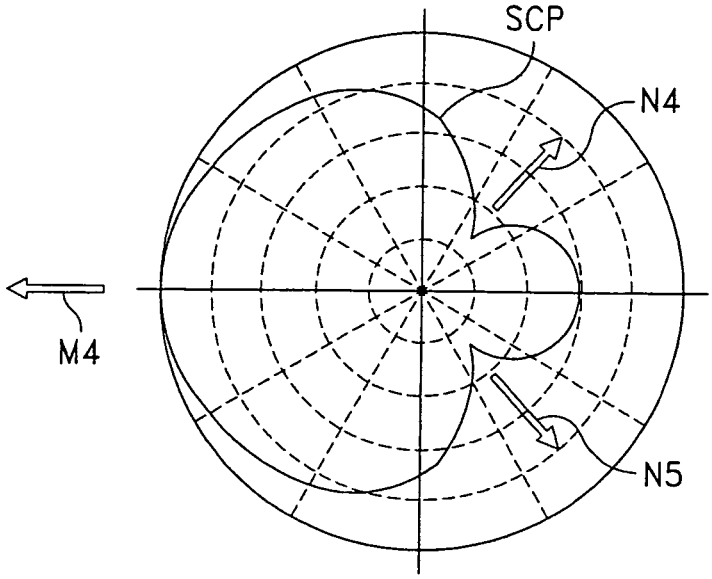
FIG. 4 is a graph of a polar directional response pattern of a supercardioid type microphone.
Figure 5:
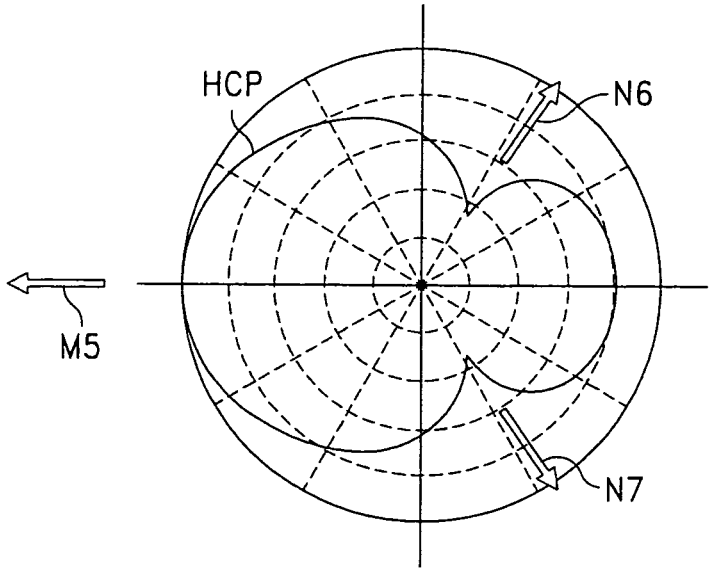
FIG. 5 is a graph of a polar directional response pattern of a hypercardioid type microphone.
Figure 8:
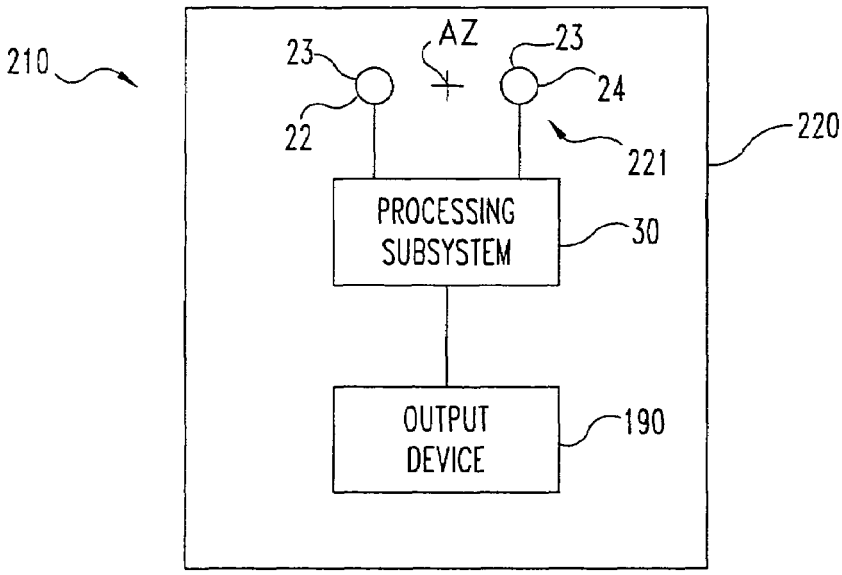
FIGS. 8 and 9 depict other embodiments of the present invention corresponding to hands-free telephony and computer voice recognition applications of the system of FIG. 1, respectively.

FIG. 3 provides a graph of directional response pattern BP of a pressure-difference type microphone having a bidirectional or figure-8 pattern in the previously described polar format. For pattern BP, there are two, generally opposing maximum response directions designated by arrows M2 and M3 at the zero degree and 180 degree locations of the FIG. 3 graph, respectively. Likewise, there are two, generally opposing minimum response directions designated by arrows N2 and N3 at the −90 degree and +90 degree locations of the FIG. 3 graph, respectively. FIG. 4 illustrates a directional response pattern for supercardioid pattern SCP in the polar format previously described. Pattern SCP has two minimum response directions designated by arrows N4 and N5, respectively; and a maximum response direction designated by arrow M4. FIG. 5 illustrates a hypercardioid pattern HCP in the previously described polar format, with minimum response directions designated by arrows N6 and N7, respectively; and a maximum response direction designated by arrow M5. While a polar format is used to characterize the directional patterns in FIGS. 2-5, it should be understood that other formats could be used to characterize directional sensors used in inventions of the present application.

Other types of directional patterns and/or acoustic/sound sensor types can be utilized in other embodiments. Alternatively or additionally, more or fewer acoustic sources at different azimuths may be present; where the illustrated number and arrangement of sources 12, 14, 16 is provided as merely one of many examples. In one such example, a room with several groups of individuals engaged in simultaneous conversation may provide a number of the sources.

Referring again to FIG. 1, sensors 22, 24 are operatively coupled to processing subsystem 30 to process signals received therefrom. For the convenience of description, sensors 22, 24 are designated as belonging to channel A and channel B, respectively. Further, the analog time domain signals provided by sensors 22, 24 to processing subsystem 30 are designated $x_A(t)$ and $x_B(t)$ for the respective channels A and B. Processing subsystem 30 is operable to provide an output signal that suppresses interference from sources 14, 16 in favor of acoustic excitation detected from the selected acoustic source 12 positioned along axis AZ. This output signal is provided to output device 90 for presentation to a user in the form of an audible or visual signal which can be further processed.

Figure 6:
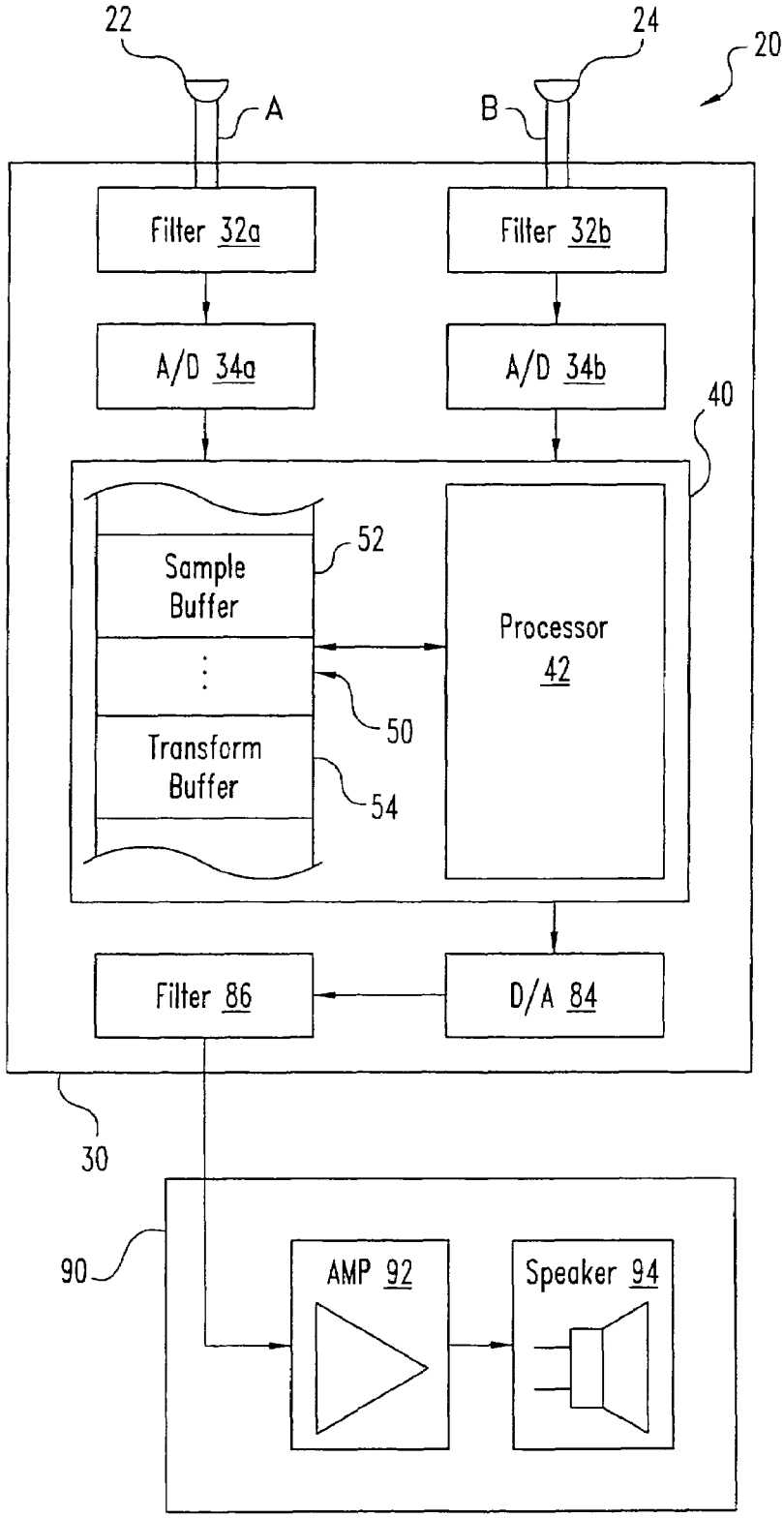
FIG. 6 is a diagram further depicting selected aspects of the system of FIG. 1.

Referring additionally to FIG. 6, a diagram is provided that depicts other details of system 10. Processing subsystem 30 includes signal conditioner/filters 32*a* and 32*b* to filter and condition input signals $x_A(t)$ and $x_B(t)$ from sensors 22, 24; where t represents time. After signal conditioner/filter 32*a* and 32*b*, the conditioned signals are input to corresponding Analog-to-Digital (A/D) converters 34*a*, 34*b* to provide discrete signals $x_A(z)$ and $x_B(z)$, for channels A and B, respectively; where z indexes discrete sampling events. The sampling rates is selected to provide desired fidelity for a frequency range of interest. Processing subsystem 30 also includes digital circuitry 40 comprising processor 42 and memory 50. Discrete signals $x_A(z)$ and $x_B(z)$ are stored in sample buffer 52 of memory 50 in a First-In-First-Out (FIFO) fashion.

Processor 42 can be a software or firmware programmable device, a state logic machine, or a combination of both programmable and dedicated hardware. Furthermore, processor 42 can be comprised of one or more components and can include one or more Central Processing Units (CPUs). In one embodiment, processor 42 is in the form of a digitally programmable, highly integrated semiconductor chip particularly suited for signal processing. In other embodiments, processor 42 may be of a general purpose type or other arrangement as would occur to those skilled in the art.

Likewise, memory 50 can be variously configured as would occur to those skilled in the art. Memory 50 can include one or more types of solid-state electronic memory, magnetic memory, or optical memory of the volatile and/or nonvolatile variety. Furthermore, memory can be integral with one or more other components of processing subsystem 30 and/or comprised of one or more distinct components.

Processing subsystem 30 can include any oscillators, control clocks, interfaces, signal conditioners, additional filters, limiters, converters, power supplies, communication ports, or other types of components as would occur to those skilled in the art to implement the present invention. In one embodiment, some or all of the operational components of subsystem 30 are provided in the form of a single, integrated circuit device.

Figure 7:
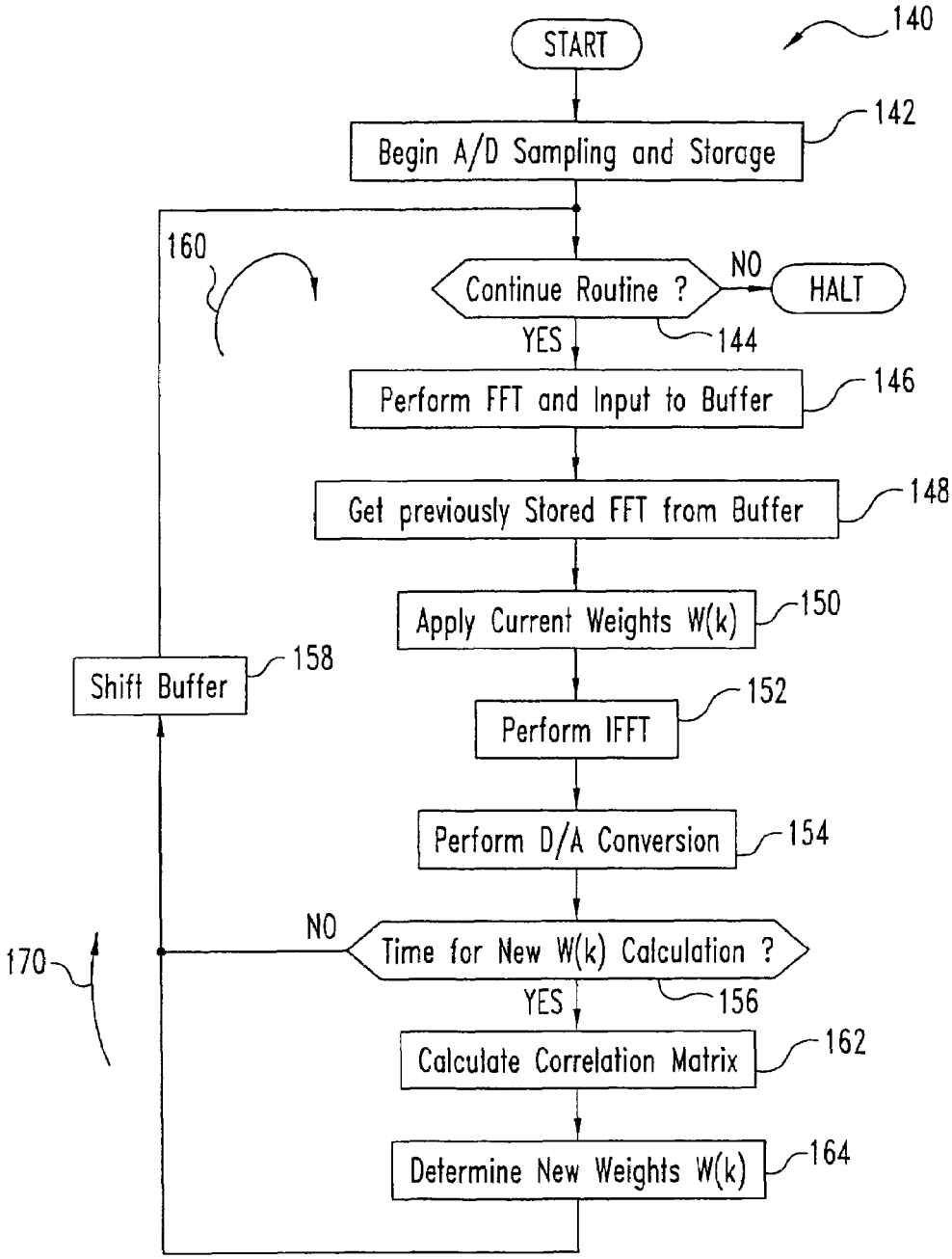
FIG. 7 is a flow chart of a routine for operating the system of FIG. 1.

Referring also to the flow chart of FIG. 7, routine 140 is illustrated. Digital circuitry 40 is configured to perform routine 140. Processor 42 executes logic to perform at least some the operations of routine 140. By way of nonlimiting example, this logic can be in the form of software programming instructions, hardware, firmware, or a combination of these. The logic can be partially or completely stored on memory 50 and/or provided with one or more other components or devices. Additionally or alternatively, such logic can be provided to processing subsystem 30 in the form of signals that are carried by a transmission medium such as a computer network or other wired and/or wireless communication network.

In stage 142, routine 140 begins with initiation of the A/D sampling and storage of the resulting discrete input samples $x_A(z)$ and $x_B(z)$ in buffer 52 as previously described. Sampling is performed in parallel with other stages of routine 140 as will become apparent from the following description. Routine 140 proceeds from stage 142 to conditional 144. Conditional 144 tests whether routine 140 is to continue. If not, routine 140 halts. Otherwise, routine 140 continues with stage 146. Conditional 144 can correspond to an operator switch, control signal, or power control associated with system 10 (not shown).

In stage 146, a fast discrete fourier transform (FFT) algorithm is executed on a sequence of samples $x_A(z)$ and $x_B(z)$ and stored in buffer 54 for each channel A and B to provide corresponding frequency domain signals $X_A(k)$ and $X_B(k)$; where k is an index to the discrete frequencies of the FFTs (alternatively referred to as "frequency bins" herein). The set of samples $x_A(z)$ and $x_B(z)$ upon which an FFT is performed can be described in terms of a time duration of the sample data. Typically, for a given sampling raters, each FFT is based on more than 100 samples. Furthermore, for stage 146, FFT calculations include application of a windowing technique to the sample data. One embodiment utilizes a Hamming window. In other embodiments, data windowing can be absent or a different type utilized, the FFT can be based on a different sampling approach, and/or a different transform can be employed as would occur to those skilled in the art. After the transformation, the resulting spectra $X_A(k)$ and $X_B(k)$ are stored in FFT buffer 54 of memory 50. These spectra can be complex-valued.

It has been found that reception of acoustic excitation emanating from a desired direction can be improved by weighting and summing the input signals in a manner arranged to minimize the variance (or equivalently, the energy) of the resulting output signal while under the constraint that signals from the desired direction are output with a predetermined gain. The following relationship (1) expresses this linear combination of the frequency domain input signals:

$$Y(k) = W_A^*(k)X_A(k) + W_B^*(k)X_B(k) = W^H(k)X(k); \tag{1}$$

where:

$$W(k) = \begin{bmatrix} W_A(k) \\ W_B(k) \end{bmatrix};$$

$$X(k) = \begin{bmatrix} X_A(k) \\ X_B(k) \end{bmatrix};$$

Y(k) is the output signal in frequency domain form, $W_A(k)$ and $W_B(k)$ are complex valued multipliers (weights) for each frequency k corresponding to channels A and B, the superscript "*" denotes the complex conjugate operation, and the superscript "H" denotes taking the Hermitian transpose of a vector. For this approach, it is desired to determine an "optimal" set of weights $W_A(k)$ and $W_B(k)$ to minimize variance of Y(k). Minimizing the variance generally causes cancellation of sources not aligned with the desired direction. For the mode of operation where the desired direction is along axis AZ, frequency components which do not originate from directly ahead of the array are attenuated because they are not consistent in amplitude and possibly phase across channels A and B. Minimizing the variance in this case is equivalent to minimizing the output power of off-axis sources, as related by the optimization goal of relationship (2) that follows:

$$\underset{W}{\text{Min}}\ E\{|Y(k)|^2\} \tag{2}$$

where Y(k) is the output signal described in connection with relationship (1). In one form, the constraint requires that "on axis" acoustic signals from sources along the axis AZ be passed with unity gain as provided in relationship (3) that follows:

$$e^H W(k)=1 \tag{3}$$

Here e is a two element vector which corresponds to the desired direction. When this direction is coincident with axis AZ, sensors 22 and 24 generally receive the signal at the same time and possibly with an expected difference in amplitude, and thus, for source 12 of the illustrated embodiment, the vector e is real-valued with equal weighted elements—for instance $e^H$=[1 1]. In contrast, if the selected acoustic source is not on axis AZ, then sensors 22, 24 can be steered to align axis AZ with it.

In an additional or alternative mode of operation, the elements of vector e can be selected to monitor along a desired direction that is not coincident with axis AZ. For such operating modes, vector e possibly becomes complex-valued to represent the appropriate time/amplitude/phase difference between sensors 22, 24 that correspond to acoustic excitation off axis AZ. Thus, vector e operates as the direction indicator previously described. Correspondingly, alternative embodiments can be arranged to select a desired acoustic excitation source by establishing a different geometric relationship relative to axis AZ. For instance, the direction for monitoring a desired source can be disposed at a nonzero azimuthal angle relative to axis AZ. Indeed, by changing vector e, the monitoring direction can be steered from one direction to another without moving either sensor 22, 24.

For the general case of a system with C sensors, the vector e is the steering vector describing the weights and delays associated with a desired monitoring direction and is of the form provided by relationship (4):

$$e(\phi) = [a_1(k)e^{+j\phi_1(k)}a_2(k)e^{+j\phi_2(k)} \ldots a_C(k)e^{+j\phi_C(k)}]^T \tag{4}$$

where $a_n$ is a real-valued constant representing the amplitude of the response from each channel n for the target direction, and $\phi_n(k)$ represents the relative phase delay of each channel n. For the specific case of a linearly spaced array in free space, $\phi_n(k)$ is defined by relationship (5):

$$\phi_n(k) = (n-1)\cdot\frac{2\pi\cdot k\cdot D\cdot f_s}{c\cdot N}\cdot\sin(\theta),\ \text{for } k = 0, 1, \ldots, N-1 \tag{5}$$

where c is the speed of sound in meters per second, D is the spacing between array elements in meters, $f_s$ is the sampling frequency in Hertz, and θ is the desired "look direction." If the array is not linearly spaced or if the sensors are not in free space, the expression for $\phi_n(k)$ may become more complex. Thus, vector e may be varied with frequency to change the desired monitoring direction or look-direction and correspondingly steer the response of the array of differently oriented directional sensors.

For inputs $X_A(k)$ and $X_B(k)$ that generally correspond to stationary random processes (which is typical of speech signals over small periods of time), the following weight vector W(k) in relationship (6) can be determined from relationships (2) and (3):

$$W(k) = \frac{R(k)^{-1}e}{e^H R(k)^{-1}e} \tag{6}$$

where e is the vector associated with the desired reception direction, R(k) is the correlation matrix for the $k^{th}$ frequency, W(k) is the optimal weight vector for the $k^{th}$ frequency and the superscript "−1" denotes the matrix inverse. The derivation of this relationship is explained in connection with a general model of the present invention applicable to embodiments with more than two sensors 22, 24 in array 20.

The correlation matrix R(k) can be estimated from spectral data obtained via a number "F" of fast discrete Fourier transforms (FFTs) calculated over a relevant time interval. For the two channel (channels A and B) embodiment, the correlation matrix for the $k^{th}$ frequency, R(k), is expressed by the following relationship (7):

$$R(k) = \begin{bmatrix} \frac{M}{F}\sum_{n=1}^{F} X_A^*(n,k)X_A(n,k) & \frac{1}{F}\sum_{n=1}^{F} X_A^*(n,k)X_B(n,k) \\ \frac{1}{F}\sum_{n=1}^{F} X_B^*(n,k)X_A(n,k) & \frac{M}{F}\sum_{n=1}^{F} X_B^*(n,k)X_B(n,k) \end{bmatrix} = \begin{bmatrix} R_{AA}(k) & R_{AB}(k) \\ R_{BA}(k) & R_{BB}(k) \end{bmatrix} \tag{7}$$

where $X_A$ is the FFT in the frequency buffer for channel A and $X_B$ is the FFT in the frequency buffer for channel B obtained from previously stored FFTs that were calculated from an earlier execution of stage 146; "n" is an index to the number "F" of FFTs used for the calculation; and "M" is a regularization parameter. The terms $R_{AA}(k)$, $R_{AB}(k)$, $R_{BA}(k)$, and $R_{BB}(k)$ represent the weighted sums for purposes of compact expression.

Accordingly, in stage 148 spectra $X_A(k)$ and $X_B(k)$ previously stored in buffer 54 are read from memory 50 in a First-In-First-Out (FIFO) sequence. Routine 140 then proceeds to stage 150. In stage 150, multiplier weights $W_A^*(k)$, $W_B^*(k)$ are applied to $X_A(k)$ and $X_B(k)$, respectively, in accordance with the relationship (1) for each frequency k to provide the output spectra Y(k). Routine 140 continues with stage 152 which performs an Inverse Fast Fourier Transform (IFFT) to change the Y(k) FFT determined in stage 150 into a discrete time domain form designated y(z). Next, in stage 154, a Digital-to-Analog (D/A) conversion is performed with D/A converter 84 (FIG. 6) to provide an analog output signal y(t). It should be understood that correspondence between Y(k) FFTs and output sample y(z) can vary. In one embodiment, there is one Y(k) FFT output for every y(z), providing a one-to-one correspondence. In another embodiment, there may be one Y(k) FFT for every 16 output samples y(z) desired, in which case the extra samples can be obtained from available Y(k) FFTs. In still other embodiments, a different correspondence may be established.

After conversion to the continuous time domain form, signal y(t) is input to signal conditioner/filter 86. Conditioner/filter 86 provides the conditioned signal to output device 90. As illustrated in FIG. 6, output device 90 includes an amplifier 92 and audio output device 94. Device 94 may be a loudspeaker, hearing aid receiver output, or other device as would occur to those skilled in the art. It should be appreciated that system 10 processes a dual input to produce a single output. In some embodiments, this output could be further processed to provide multiple outputs. In one hearing aid application example, two outputs are provided that delivers generally the same sound to each ear of a user. In another hearing aid application, the sound provided to each ear selectively differs in terms of intensity and/or timing to account for differences in the orientation of the sound source to each sensor 22, 24, improving sound perception.

After stage 154, routine 140 continues with conditional 156. In many applications it may not be desirable to recalculate the elements of weight vector W(k) for every Y(k). Accordingly, conditional 156 tests whether a desired time interval has passed since the last calculation of vector W(k). If this time period has not lapsed, then control flows to stage 158 to shift buffers 52, 54 to process the next group of signals.

From stage 158, processing loop 160 closes, returning to conditional 144. Provided conditional 144 remains true, stage 146 is repeated for the next group of samples of $x_L(z)$ and $x_R(z)$ to determine the next pair of $X_A(k)$ and $X_B(k)$ FFTs for storage in buffer 54. Also, with each execution of processing loop 160, stages 148, 150, 152, 154 are repeated to process previously stored $x_A(k)$ and $x_B(k)$ FFTs to determine the next Y(k) FFT and correspondingly generate a continuous y(t). In this manner buffers 52, 54 are periodically shifted in stage 158 with each repetition of loop 160 until either routine 140 halts as tested by conditional 144 or the time period of conditional 156 has lapsed.

If the test of conditional 156 is true, then routine 140 proceeds from the affirmative branch of conditional 156 to calculate the correlation matrix R(k) in accordance with relationship (5) in stage 162. From this new correlation matrix R(k), an updated vector W(k) is determined in accordance with relationship (4) in stage 164. From stage 164, update loop 170 continues with stage 158 previously described, and processing loop 160 is re-entered until routine 140 halts per conditional 144 or the time for another recalculation of vector W(k) arrives. Notably, the time period tested in conditional 156 may be measured in terms of the number of times loop 160 is repeated, the number of FFTs or samples generated between updates, and the like. Alternatively, the period between updates can be dynamically adjusted based on feedback from an operator or monitoring device (not shown).

When routine 140 initially starts, earlier stored data is not generally available. Accordingly, appropriate seed values may be stored in buffers 52, 54 in support of initial processing. In other embodiments, a greater number of acoustic sensors can be included in array 20 and routine 140 can be adjusted accordingly.

Referring to relationship (7), regularization factor M typically is slightly greater than 1.00 to limit the magnitude of the weights in the event that the correlation matrix R(k) is, or is close to being, singular, and therefore noninvertable. This occurs, for example, when time-domain input signals are exactly the same for F consecutive FFT calculations.

In one embodiment, regularization factor M is a constant. In other embodiments, regularization factor M can be used to adjust or otherwise control the array beamwidth, or the angular range at which a sound of a particular frequency can impinge on the array relative to axis AZ and be processed by routine 140 without significant attenuation. This beamwidth is typically larger at lower frequencies than higher frequencies, and increases with regularization factor M. Accordingly, in one alternative embodiment of routine 140, regularization factor M is increased as a function of frequency to provide a more uniform beamwidth across a desired range of frequencies. In another embodiment of routine 140, M is alternatively or additionally varied as a function of time. For example, if little interference is present in the input signals in certain frequency bands, the regularization factor M can be increased in those bands. In a further variation, this regularization factor M can be reduced for frequency bands that contain interference above a selected threshold. In still another embodiment, regularization factor M varies in accordance with an adaptive function based on frequency-band-specific interference. In yet further embodiments, regularization factor M varies in accordance with one or more other relationships as would occur to those skilled in the art.

Referring to FIG. 8, one application of the various embodiments of the present invention is depicted as hands-free telephony device 210; where like reference numerals refer to like features. In one embodiment, system 210 includes a cellular telephone handset 220 with sound input arrangement 221. Arrangement 221 includes acoustic sensors 22 and 24 in the form of microphones 23. Acoustic sensors 22 and 24 are fixed to handset 220 in this embodiment, minimally spaced apart from one another or collocated, and are operatively coupled to processing subsystem 30 previously described. Subsystem 30 is operatively coupled to output device 190. Output device 190 is in the form of an audio loudspeaker subsystem that can be used to provide an acoustic output to the user of system 210. Processing subsystem 30 is configured to perform routine 140 and/or its variations with output signal y(t) being provided to output device 190 instead of output device 90 of FIG. 6. This arrangement defines axis AZ to be perpendicular to the view plane of FIG. 8 as designated by the like-labeled cross-hairs located generally midway between sensors 22 and 24.

In operation, the user of handset 220 can selectively receive an acoustic signal by aligning the corresponding source with a designated direction, such as axis AZ. As a result, sources from other directions are attenuated. Moreover, the wearer may select a different signal by realigning axis AZ with another desired sound source and correspondingly suppress one or more different off-axis sources. Alternatively or additionally, system 210 can be configured to operate with a reception direction that is not coincident with axis AZ. In a further alternative form, hands-free telephone system 210 includes multiple devices distributed within the passenger compartment of a vehicle to provide hands-free operation. For example, one or more loudspeakers and/or one or more acoustic sensors can be remote from handset 220 in such alternatives.

Figure 9:
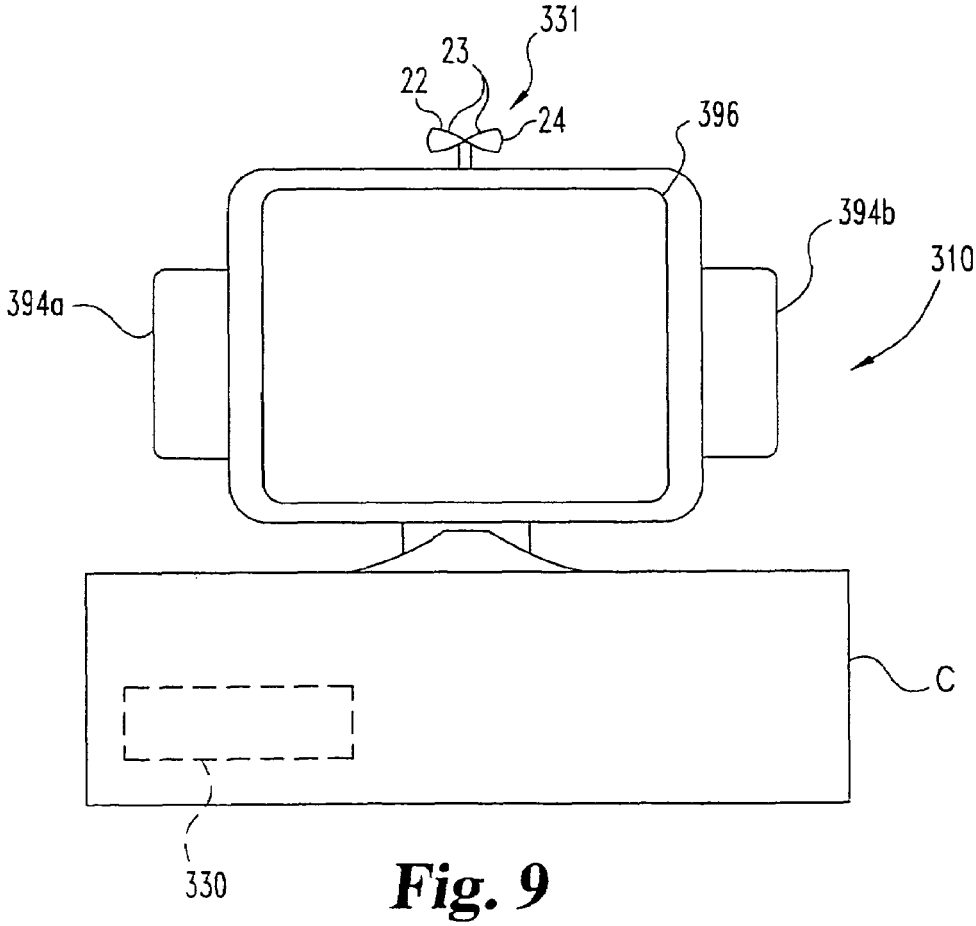

FIG. 9 depicts a different embodiment in the form of voice input device 310 employing the present invention as a front end speech enhancement device for a voice recognition routine for personal computer C; where like reference numerals refer to like features. Device 310 includes sound input arrangement 331. Arrangement 331 includes acoustic sensors 22, 24 in the form of microphones 23 positioned relative to each other in a predetermined relationship. Sensors 22, 24 are operatively coupled to processor 330 within computer C. Processor 330 provides an output signal for internal use or responsive reply via speakers 394*a*, 394*b* and/or visual display 396; and is arranged to process vocal inputs from sensors 22, 24 in accordance with routine 140 or its variants. In one mode of operation, a user of computer C aligns with a predetermined axis to deliver voice inputs to device 310. In another mode of operation, device 310 changes its monitoring direction based on feedback from an operator and/or automatically selects a monitoring direction based on the location of the most intense sound source over a selected period of time. In other voice input applications, the directionally selective speech processing features of the present invention are utilized to enhance performance of other types of telephone devices, remote telepresence and/or teleconferencing systems, audio surveillance devices, or a different audio system as would occur to those skilled in the art.

Under certain circumstances, the directional orientation of a sensor array relative to the target acoustic source changes. Without accounting for such changes, attenuation of the target signal can result. This situation can arise, for example, when a hearing aid wearer turns his or her head so that he or she is not aligned properly with the target source, and the hearing aid does not otherwise account for this misalignment. It has been found that attenuation due to misalignment can be reduced by localizing and/or tracking one or more acoustic sources of interest.

In a further embodiment, one or more transformation techniques are utilized in addition to or as an alternative to fourier transforms in one or more forms of the invention previously described. One example is the wavelet transform, which mathematically breaks up the time-domain waveform into many simple waveforms, which may vary widely in shape. Typically wavelet basis functions are similarly shaped signals with logarithmically spaced frequencies. As frequency rises, the basis functions become shorter in time duration with the inverse of frequency. Like fourier transforms, wavelet transforms represent the processed signal with several different components that retain amplitude and phase information. Accordingly, routine 140 and/or routine 520 can be adapted to use such alternative or additional transformation techniques. In general, any signal transform components that provide amplitude and/or phase information about different parts of an input signal and have a corresponding inverse transformation can be applied in addition to or in place of FFFs.

Routine 140 and the variations previously described generally adapt more quickly to signal changes than conventional time-domain iterative-adaptive schemes. In certain applications where the input signal changes rapidly over a small interval of time, it may be desired to be more responsive to such changes. For these applications, the F number of FFT's associated with correlation matrix R(k) may provide a more desirable result if it is not constant for all signals (alternatively designated the correlation length F). Generally, a smaller correlation length F is best for rapidly changing input signals, while a larger correlation length F is best for slowly changing input signals.

A varying correlation length F can be implemented in a number of ways. In one example, filter weights are determined using different parts of the frequency-domain data stored in the correlation buffers. For buffer storage in the order of the time they are obtained (First-In, First-Out (FIFO) storage), the first half of the correlation buffer contains data obtained from the first half of the subject time interval and the second half of the buffer contains data from the second half of this time interval. Accordingly, the correlation matrices $R_1(k)$ and $R_2(k)$ can be determined for each buffer half according to relationships (8) and (9) as follows:

$$R_1(k)=\begin{bmatrix} \frac{2M}{F}\sum_{n=1}^{\frac{F}{2}} X_A^*(n,k)X_A(n,k) & \frac{2}{F}\sum_{n=1}^{\frac{F}{2}} X_A^*(n,k)X_B(n,k) \\ \frac{2}{F}\sum_{n=1}^{\frac{F}{2}} X_B^*(n,k)X_A(n,k) & \frac{2M}{F}\sum_{n=1}^{\frac{F}{2}} X_B^*(n,k)X_B(n,k) \end{bmatrix} \tag{8}$$

$$R_2(k)=\begin{bmatrix} \frac{2M}{F}\sum_{n=\frac{F}{2}+1}^{F} X_A^*(n,k)X_A(n,k) & \frac{2}{F}\sum_{n=\frac{F}{2}+1}^{F} X_A^*(n,k)X_B(n,k) \\ \frac{2}{F}\sum_{n=\frac{F}{2}+1}^{F} X_B^*(n,k)X_A(n,k) & \frac{2M}{F}\sum_{n=\frac{F}{2}+1}^{F} X_B^*(n,k)X_B(n,k) \end{bmatrix} \tag{9}$$

R(k) can be obtained by summing correlation matrices $R_1(k)$ and $R_2(k)$.

Using relationship (6) of routine 140, filter coefficients (weights) can be obtained using both $R_1(k)$ and $R_2(k)$. If the weights differ significantly for some frequency band k between $R_1(k)$ and $R_2(k)$, a significant change in signal statistics may be indicated. This change can be quantified by examining the change in one weight through determining the magnitude and phase change of the weight and then using these quantities in a function to select the appropriate correlation length F. The magnitude difference is defined according to relationship (10) as follows:

$$\Delta M_A(k)=\|w_{A,1}(k)|-|w_{A,2}(k)\| \tag{10}$$

where $w_{A,1}(k)$ and $w_{A,2}(k)$ are the weights calculated for the left channel using $R_1(k)$ and $R_2(k)$, respectively. The angle difference is defined according to relationship (11) as follows:

$$\begin{aligned} \Delta A_A(k) &= |\min(a_1 - \angle w_{A,2}(k),\ a_2 - \angle w_{A,2}(k),\ a_3 - \angle w_{A,2}(k))| \\ a_1 &= \angle w_{A,1}(k) \\ a_2 &= \angle w_{A,1}(k) + 2\pi \\ a_3 &= \angle w_{A,1}(k) - 2\pi \end{aligned} \tag{11}$$

where the factor of $\pm 2\pi$ is introduced to provide the actual phase difference in the case of a $\pm 2\pi$ jump in the phase of one of the angles. Similar techniques may be used for any other channel such as channel B, or for combinations of channels.

The correlation length F for some frequency bin k is now denoted as F(k). An example function is given by the following relationship (12):

$$F(k)=\max(b(k)\cdot\Delta A_A(k)+d(k)\cdot\Delta M_A(k)+c_{max}(k),\ c_{min}(k)) \tag{12}$$

where $c_{min}(k)$ represents the minimum correlation length, $c_{max}(k)$ represents the maximum correlation length and b(k) and d(k) are negative constants, all for the $k^{th}$ frequency band. Thus, as $\Delta A_A(k)$ and $\Delta M_A(k)$ increase, indicating a change in the data, the output of the function decreases. With proper choice of b(k) and d(k), F(k) is limited between $c_{min}(k)$ and $c_{max}(k)$, so that the correlation length can vary only within a predetermined range. It should also be understood that F(k) may take different forms, such as a nonlinear function or a function of other measures of the input signals.

Values for function F(k) are obtained for each frequency bin k. It is possible that a small number of correlation lengths may be used, so in each frequency bin k the correlation length that is closest to $F_1(k)$ is used to form R(k). This closest value is found using relationship (13) as follows:

$$\begin{aligned} i_{\min} &= \min_i(|F_1(k) - c(i)|),\ c(i) = [c_{\min}, c_2, c_3, \ldots, c_{\max}] \\ F(k) &= c(i_{\min}) \end{aligned} \tag{13}$$

where $i_{min}$, is the index for the minimized function F(k) and c(i) is the set of possible correlation length values ranging from $c_{min}$ to $c_{max}$.

The adaptive correlation length process can be incorporated into the correlation matrix stage 162 and weight determination stage 164 for use in a hearing aid. Logic of processing subsystem 30 can be adjusted as appropriate to provide for this incorporation. The application of adaptive correlation length can be operator selected and/or automatically applied based on one or more measured parameters as would occur to those skilled in the art.

Figure 10:
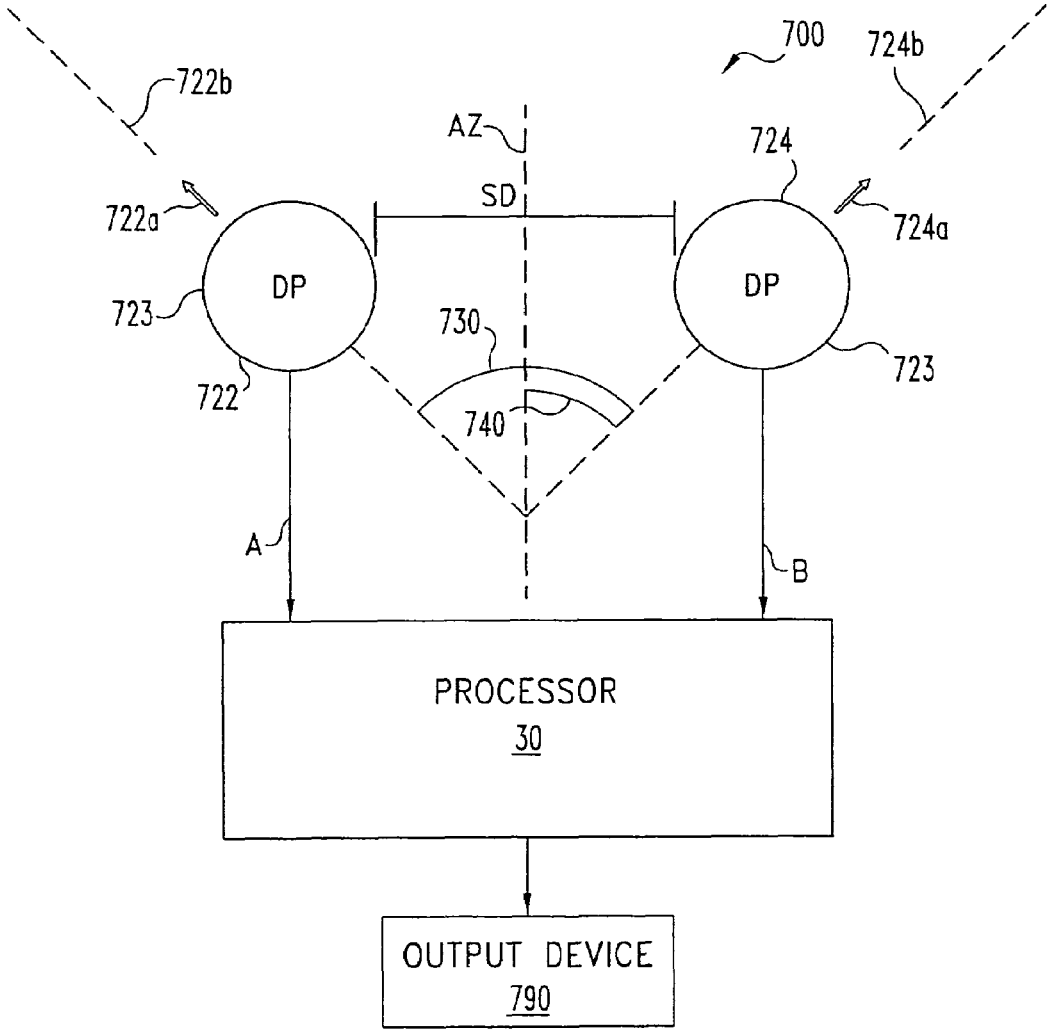
FIG. 10 is a diagrammatic view of a system of still a further embodiment of the present invention.

Referring to FIG. 10, acoustic signal detection/processing system 700 is illustrated. In system 700, directional acoustic sensors 722 and 724, separated from one another by sensor-to-sensor distance SD, each have a directional response pattern DP and are each in the form of a directional microphone 723. Directional response pattern DP for each sensor 722 and 724 has a maximum response direction designated by arrows 722*a* and 724*a*, respectively. Axes 722*b* and 724*b* are coincident with arrows 722*a* and 724*a*, intersecting one another along axis AZ. Axis 722*b* forms an angle 730 which is approximately bisected by axis AZ to provide an angle 740 between axis AZ and each of axes 722*b* and 724*b*; where angle 740 is approximately one half of angle 730. Sensors 722 and 724 are operatively coupled to processing subsystem 30 as previously described. Processing subsystem 30 is coupled to output device 790 which can be the same as output device 90 or output device 190 previously described. For this embodiment, angle 730 is preferably in a range of about 10 degrees through about 180 degrees. It should be understood that if angle 730 equals 180 degrees, axes 722*b* and 724*b* are coincident and the directions of arrows 722*a* and 724*a* are generally opposite one another. In a more preferred form of this embodiment, angle 730 is in a range of about 20 degrees to about 160 degrees. In still a more preferred form of this embodiment, angle 730 is in a range of about 45 degrees to about 135 degrees. In a most preferred form of this embodiment, angle 730 is approximately 90 degrees.

Figure 11:
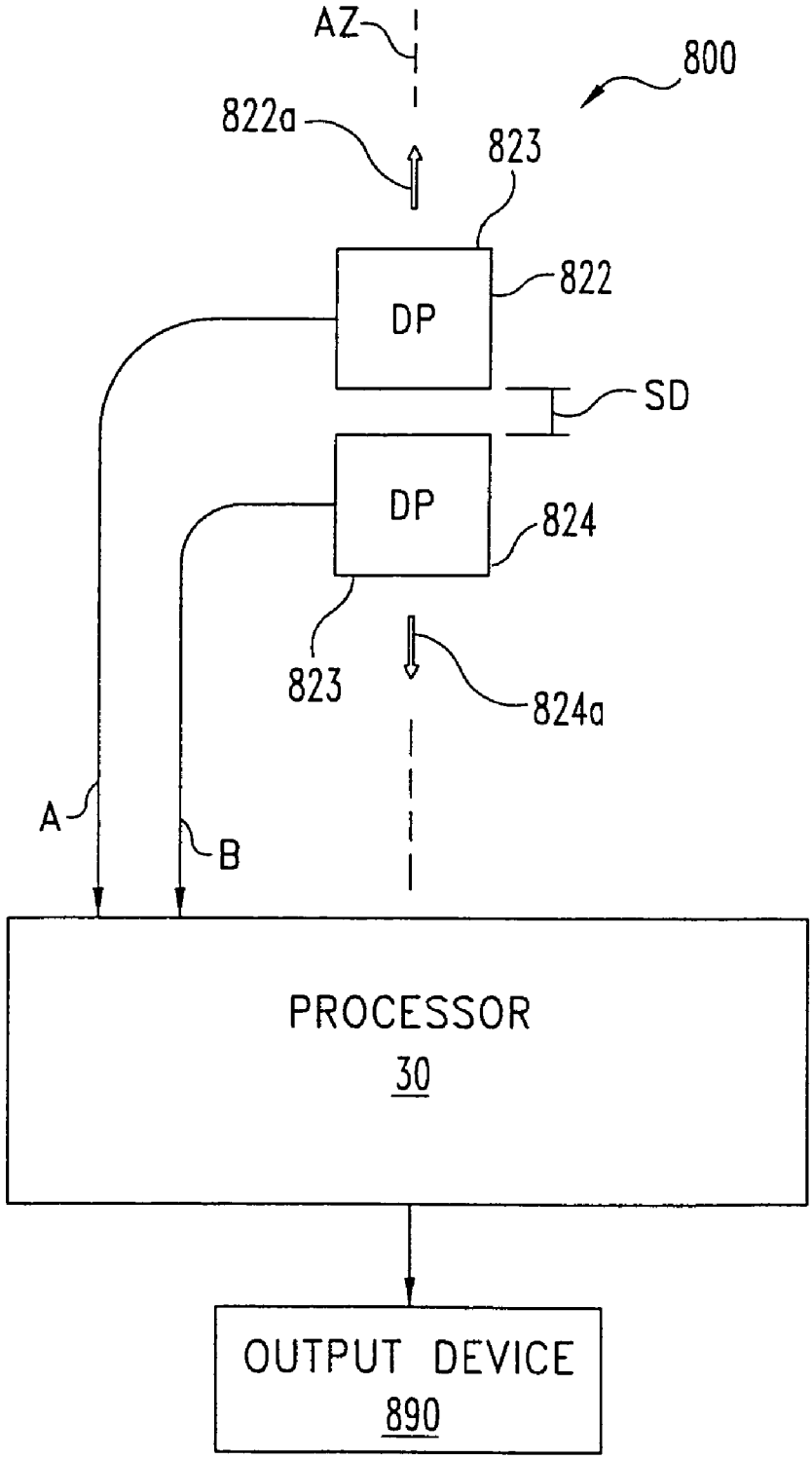
FIG. 11 is a diagrammatic view of a system of yet a further embodiment of the present invention.

FIG. 11 illustrates system 800 with yet a different orientation of sensor directional response patterns. In system 800, directional acoustic sensors 822 and 824 are separated from one another by sensor-to-sensor separation distance SD and each have a directional response pattern DP as previously described. As depicted, sensors 822 and 824 are in the form of directional microphones 823. Pattern DP has a maximum response direction indicated by arrows 822*a* and 824*a*, respectively, that are oriented in approximately opposite directions, subtending an angle of approximately 180 degrees. Further, arrows 822*a* and 824*a* are generally coincident with axis AZ. System 800 also includes processing subsystem 30 as previously described. Processing subsystem 30 is coupled to output device 890, which can be the same as output device 90 or output device 190 previously described.

Subsystem 30 of systems 700 and/or 800 can be provided with logic in the form of programming, firmware, hardware, and/or a combination of these to implement one or more of the previously described routine 140, variations of routine 140, and/or a different adaptive beamformer routine, such as any of those described in U.S. Pat. No. 5,473,701 to Cezanne; U.S. Pat. No. 5,511,128 to Lindemann; U.S. Pat. No. 6,154,552 to Koroljow; Banks, D. "Localization and Separation of Simultaneous Voices with Two Microphones" IEE Proceedings I 140, 229-234 (1992); Frost, O. L. "An Algorithm for Linearly Constrained Adaptive Array Processing" Proceedings of IEEE 60 (8), 926-935 (1972); and/or Griffiths, L. J. and Jim, C. W. "An Alternative Approach to Linearly Constrained Adaptive Beamforming" IEEE Transactions on Antennas and Propagation AP-30(1), 27-34 (1982), to name just a few. In one alternative embodiment, system 10 operates in accordance with an adaptive beamformer routine other than routine 140 and its variations described herein. In still other embodiments a fixed beamforming routine can be utilized.

In one preferred form of system 10, 700, and/or 800; directional response pattern DP is of any type and has a maximum response direction that provides a response level at least 3 decibels (dB) greater than a minimum response direction at a selected frequency. In a more preferred form, the relative difference between the maximum and minimum response direction levels is at least 6 decibels (dB) at a selected frequency. In a still more preferred embodiment, this difference is at least 12 decibels at a selected frequency and the microphones are matched with generally the same directional response pattern type. In yet another more preferred embodiment, the difference is 3 decibels or more, and the sensors include a pair of matched microphones with a directional response pattern of the cardioid, figure-8, supercardioid, or hypercardioid type. Nonetheless, in other embodiments, the sensor directional response patterns may not be matched.

It has been discovered for directional acoustic sensors with generally symmetrically arranged maximum response directions that are located relatively close to one another, that phase differences of such approximately collocated sensors often can be ignored without undesirably impacting performance. In one such embodiment, routine 140 and its variations (collectively designated the FMV routine) can be simplified to operate based generally on amplitude differences between the sensor signals for each frequency band (designated the AFMV routine). As a result, highly directional responses can be obtained from a relatively small package compared to techniques that require comparatively large sensor-to-sensor distances.

As previously described in connection with routine 140, relationships (2) and (3) provide variance and gain constraints to determine weights in accordance with relationship (6) as follows:

$$W(k) = \frac{R(k)^{-1}e}{e^H R(k)^{-1} e} \tag{6}$$

It was further described that the correlation matrix R(k) of relationship (6) can be expressed by the following relationship (7):

$$R(k) = \begin{bmatrix} \frac{M}{F}\sum_{n=1}^{F} X_A^*(n,k)X_A(n,k) & \frac{1}{F}\sum_{n=1}^{F} X_A^*(n,k)X_B(n,k) \\ \frac{1}{F}\sum_{n=1}^{F} X_B^*(n,k)X_A(n,k) & \frac{M}{F}\sum_{n=1}^{F} X_B^*(n,k)X_B(n,k) \end{bmatrix} = \begin{bmatrix} R_{AA}(k) & R_{AB}(k) \\ R_{BA}(k) & R_{BB}(k) \end{bmatrix} \tag{7}$$

When two directional sensors are located close enough to one another such that their approximate co-location results in an insignificant phase difference response of the sensors for directions and frequencies of interest, the AFMV routine can be utilized. Examples of such orientations include those shown with respect to sensors 22 and 24 in system 10, sensors 722 and 724 in system 700, and sensors 822 and 824 in system 800; where the sensor-to-sensor separation distance SD is relatively small, or near zero.

In one preferred form, directional sensors based on this model are approximately co-located such that a desired fidelity of an output generated with the AFMV routine is provided over a frequency range and directional range of interest. In a more preferred form, separation distance SD is less than about 2 centimeters (cms). In still a more preferred form, directional sensors implemented with this model have a separation distance SD of less than about 0.5 centimeter (cm). In a most preferred form, directional sensors utilized with this model have a distance of separation less than 0.2 cm. Indeed, it is contemplated in such forms, that two or more directional sensors can be so close to one another as to provide contact between corresponding sensing elements.

The FMV routine can be modified to provide the AFMV routine, which is described starting with relationships (14) as follows:

$$s_1=s_{1R}+s_{1I}$$

$$s_2=s_{2R}+s_{2I}$$

$$X_1=s_1+s_2$$

$$X_2=\alpha\cdot s_1+\beta\cdot s_2 \tag{14}$$

where $s_1$ and $s_2$ are the complex-valued representation of the sources for the $k^{th}$ frequency band, $\alpha$ and $\beta$ are real numbers, and $X_1$ and $X_2$ are the complex-valued representations of the signals received by two sensors for the $k^{th}$ frequency band. Correspondingly, the ideal correlation matrix, based on the calculation of the expected value of random variables, is expressed by relationship (15) as follows:

$$R_{ideal}=\begin{bmatrix}\sigma_1^2+\sigma_2^2 & \alpha\sigma_1^2+\beta\sigma_2^2\\ \alpha\sigma_1^2+\beta\sigma_2^2 & \alpha^2\sigma_1^2+\beta^2\sigma_2^2\end{bmatrix}=\begin{bmatrix}R_{AA} & R_{AB}\\ R_{BA} & R_{BB}\end{bmatrix} \tag{15}$$

where $\sigma_1^2$ and $\sigma_2^2$ are the powers of $s_1$ and $s_2$, respectively.

However, the correlation matrix that results from correlating real data is an estimate of this ideal matrix, $R_{ideal}$, and can contain some error. This error approaches zero as F approaches infinity. This ideal matrix $R_{ideal}$ can be estimated from known data, as follows from relationships (16a-16d):

$$R_{AA}=\sigma_1^2+\sigma_2^2+\frac{M}{F}\sum_{n=1}^{F}2(s_{1R}(n)s_{2R}(n)+s_{1I}(n)s_{2I}(n)) \tag{16a-16d}$$

$$R_{AB}=\alpha\sigma_1^2+\beta\sigma_2^2+\frac{1}{F}\left(\begin{array}{l}\sum_{n=1}^{F}(\alpha+\beta)(s_{1R}(n)s_{2R}(n)+s_{1I}(n)s_{2I}(n))+\\ j\sum_{n=1}^{F}(\alpha-\beta)(s_{1R}(n)s_{2I}(n)+s_{2R}(n)s_{1I}(n))\end{array}\right)$$

$$R_{BA}=\alpha\sigma_1^2+\beta\sigma_2^2+\frac{1}{F}\left(\begin{array}{l}\sum_{n=1}^{F}(\alpha+\beta)(s_{1R}(n)s_{2R}(n)+s_{1I}(n)s_{2I}(n))-\\ j\sum_{n=1}^{F}(\alpha-\beta)(s_{1R}(n)s_{2I}(n)+s_{2R}(n)s_{1I}(n))\end{array}\right)$$

$$R_{BB}=\alpha^2\sigma_1^2+\beta^2\sigma_2^2+\frac{M}{F}\sum_{n=1}^{F}2\alpha\beta(s_{1R}(n)s_{2R}(n)+s_{1I}(n)S_{2I}(n))$$

where subscripts R and I indicate real and imaginary parts, respectively, and n is a subscript indexing stored FFT coefficients for the $k^{th}$ frequency band, respectively.

The correlation may now be expressed in terms of $R_{ideal}$ and the real and imaginary parts of the error or bias with relationship (17) as follows:

$$R_{est}=R_{ideal}+R_{error,R}+R_{error,I} \tag{17}$$

Using relationships (16a-16d), the matrices can be expressed as follows in relationship (18):

$$R_{est}=R_{ideal}+\frac{1}{F}\begin{bmatrix}2 & \alpha+\beta\\ \alpha+\beta & 2\alpha\beta\end{bmatrix}\sum_{n=1}^{F}(s_{1R}(n)s_{2R}(n)+s_{1I}(n)s_{2I}(n))+\frac{j}{F}\begin{bmatrix}0 & \alpha-\beta\\ \beta-\alpha & 0\end{bmatrix}\sum_{n=1}^{F}(s_{1R}(n)s_{2I}(n)+s_{2R}(n)s_{1I}(n)) \tag{18}$$

Thus, the imaginary part of the estimated correlation matrix is an error term and can be neglected under suitable conditions, resulting in a substitute correlation matrix relationship (19) and corresponding weight relationship (20) as follows.

$$\tilde{R}_k=\begin{bmatrix}\frac{M}{F}\sum_{n=1}^{F}X_A(n)X_A^*(n) & \mathrm{Re}\left[\frac{1}{F}\sum_{n=1}^{F}X_A(n)X_B^*(n)\right]\\ \mathrm{Re}\left[\frac{1}{F}\sum_{n=1}^{F}X_B(n)X_A^*(n)\right] & \frac{M}{F}\sum_{n=1}^{F}X_B(n)X_B^*(n)\end{bmatrix} \tag{19}$$

$$\tilde{W}_k=\frac{\tilde{R}_k^{-1}e_k}{e_k^H\tilde{R}_k^{-1}e_k} \tag{20}$$

Relationships (19) and (20) can be used in place of relationships (6) and (7) in routine 140 to provide the AFMV routine. Further, not only can relationships (19) and (20) be used in the execution of routine 140, but also in embodiments where regularization factor M is adjusted to control beamwidth. Additionally, the steering vector $e_k$ can be modified (for each frequency band k) so that the response of the algorithm is steered in a desired direction. The vector e is chosen so that it matches the relative amplitudes in each channel for the desired direction in that frequency band. Alternatively or additionally, the procedure can be adjusted to account for directional pattern asymmetry under appropriate conditions.

For an embodiment of system 800 with a suitably small separation distance SD between sensors 822 and 824, and with patterns DP of a cardioid type for each sensor, the steering vector is: $e_k=[1\ 0\ ]^T$ because a negligible amount, if any, of the signal from straight ahead (along arrow 822*a*) should be picked up by sensor 824 given its opposite orientation relative to sensor 822.

In another embodiment, a combination of the FMV routine and the AFMV routine is utilized. In this example, a pair of cardioid-pattern sensors are oriented as shown in system 800 for each ear of a listener, the AFMV routine or other fixed or adaptive beamformer routine is utilized to generate an output from each pair, and the FMV routine is utilized to generate an output based on the two outputs from each sensor pair with an appropriate steering vector. The AFMV routine described in connection with relationships (14)-(20) can be used in connection with system 10 or system 700 where sensors 22 and 24 or sensors 722 and 724 have a suitably small separation distance SD. In still other embodiments, different configurations and arrangements of two or more directional microphones can be implemented in connection with the AFMV routine.

Figure 12:
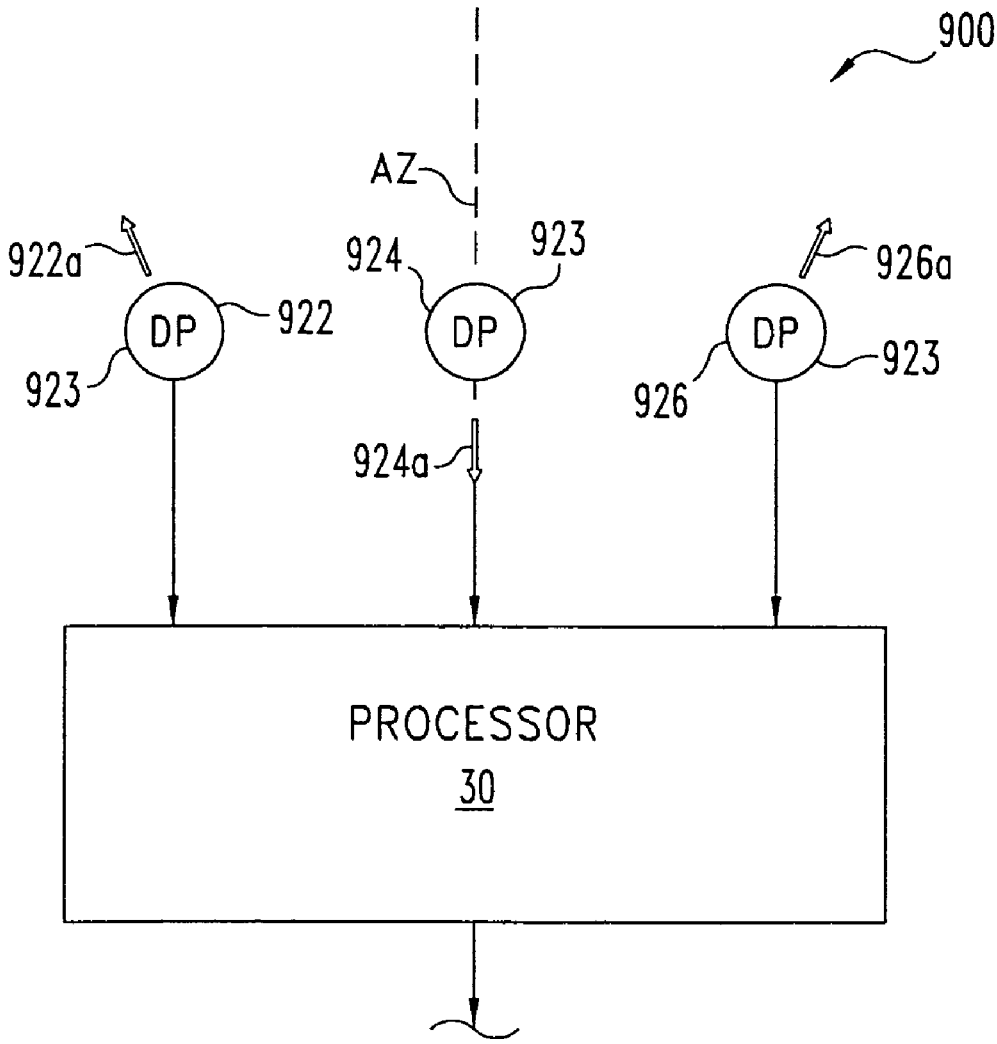
FIG. 12 is a diagrammatic view of a system of still another embodiment of the present invention.

FIG. 12 illustrates one alternative with a three sensor arrangement; where a "straight ahead" steering vector of $e_k[1\ 0\ 1]^T$ can be used for the left, center, and right sensors, respectively. In FIG. 12, system 900 includes sensors 922, 924, and 926 having maximum response directions of their respective directional response patterns indicated by arrows 922*a*, 924*a*, and 926*a*. Sensors 922, 924, 926 are depicted in the form of directional microphones 923 and are operatively coupled to processor 30. Processor 30 includes logic that can implement any of the routines previously described, adding a term to the corresponding relationships for the third sensor signal using techniques known to those of ordinary skill in the art. In one alternative embodiment of system 900, one of the sensors is of an omnidirectional type instead of a directional type (such as sensor 924).

Figure 13:
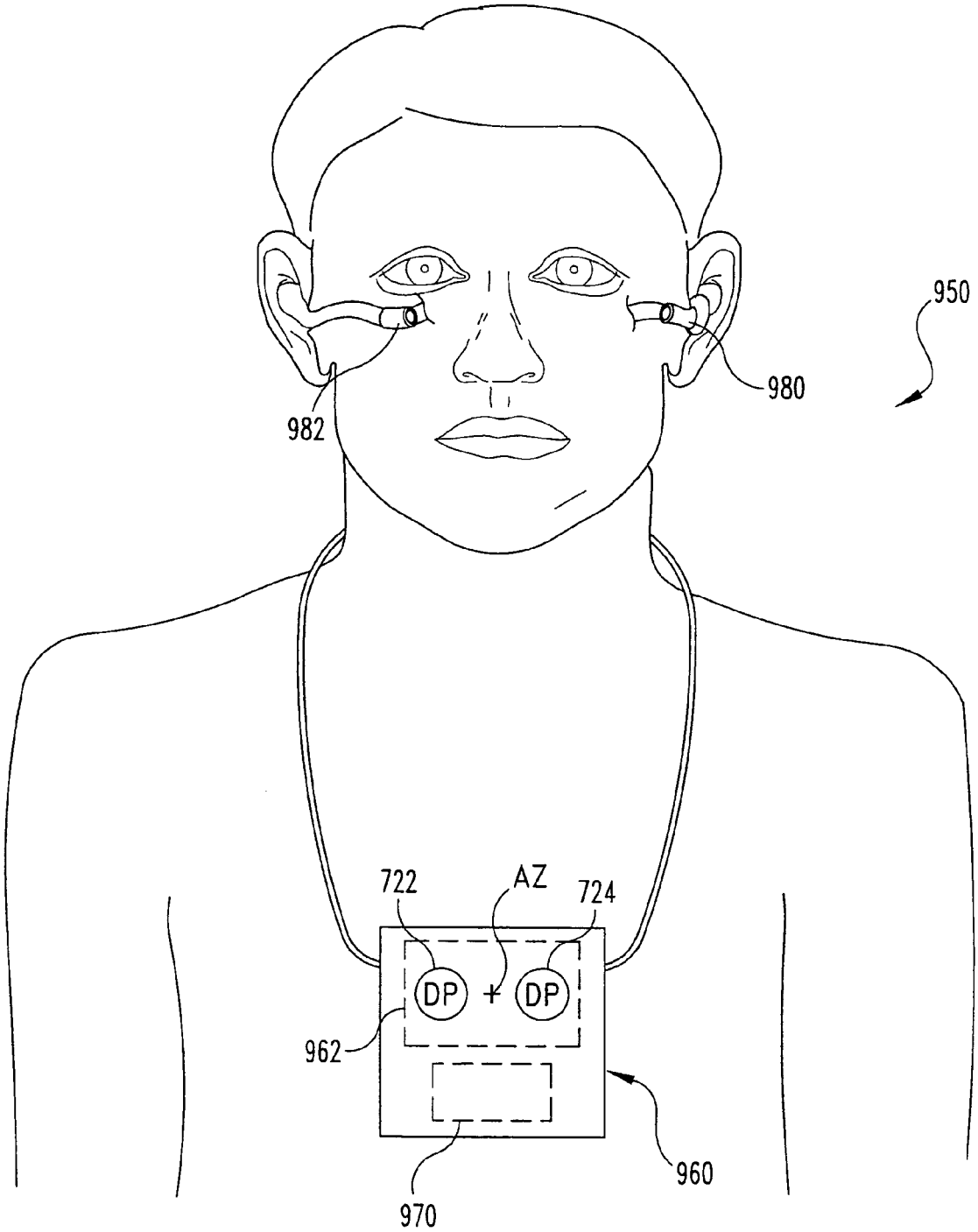
FIG. 13 is a diagrammatic view of a system of yet another embodiment of the present invention.

Generally, assisted hearing applications of the FMV routine and/or AFMV routine implemented with system 10, 700, 800, and/or 900 can provide an audio signal to the ear of the user and can be of a behind-the-ear, in-the-ear, or implanted type; a combination of these; or of such different form as would occur to those skilled in the art. In one more specific, nonlimiting embodiment, FIG. 13 illustrates hearing aid system 950 which depicts a user-worn device 960 carrying a fixed sound input device arrangement 962 of directional acoustic sensors 722 and 724. Arrangement 962 fixes the position of sensors 722 and 724 relative to one another in the orientation described in connection with system 700. Arrangement 962 also provides a separation distance SD of less than two centimeters suitable for application of the AFMV routine for desired frequency and distance performance levels of a human hearing aid. Axis AZ is represented by crosshairs and is generally perpendicular to the view plane of FIG. 13.

System 950 further includes integrated circuitry 970 carried by device 960. Circuitry 970 is operatively coupled to sensors 722 and 724 and includes a processor arranged to execute the AFMV routine. Alternatively, the FMV routine, its variations, and/or a different adaptive beamformer routine can be implemented. Device 960 further includes a power supply and such other devices and controls as would occur to one skilled in the art to provide a suitable hearing aid arrangement. System 950 also includes in-the-ear audio output device 980 and cochlear implant 982. Circuitry 970 generates an output signal that is received by in-the-ear audio output device 980 and/or cochlear implant device 982. Cochlear implant 982 is typically disposed along the ear passage of a user and is configured to provide electrical stimulation signals to the inner ear in a standard manner. Transmission between device 960 and devices 980 and 982 can be by wire or through any wireless technique as would occur to one skilled in the art. While devices 980 and 982 are shown in a common system for convenience of illustration, it should be understood that in other embodiments one type of output device 980 or 982 is utilized to the exclusion of the other. Alternatively or additionally, sensors configured to implement the AFMV procedure can be used in other hearing aid embodiments sized and shaped to fit just one ear of the listener with processing adjusted to account for acoustic shadowing caused by the head, torso, or pinnae. In still another embodiment, a hearing aid system utilizing the AFMV procedure could be utilized with a cochlear implant where some or all of the processing hardware is located in the implant device.

Besides hearing aids, the FMV and/or AFMV routines of the present invention can be used together or separately in connection with other aural or audio applications such as the hands-free telephony system 210 of FIG. 8 and/or voice recognition device 310 of FIG. 9. In the case of device 310 in particular, processor 330 within computer C can be utilized to perform some or all of the signal processing of the FMV and/or AFMV routines. Further, the AFMV procedure can be utilized in association with a source localization/tracking ability. In still another voice input application, the directionally selective speech processing features of any form of the present invention can be utilized to enhance performance of remote telepresence equipment, audio surveillance devices, speech recognition, and/or to improve noise immunity for wireless acoustic arrays.

In one preferred embodiment of the present invention, one or more of the previously described systems and/or attendant processes are directed to the detection and processing of a broadband acoustic signal having a range of at least one-third of an octave. In a more preferred broadband-directed embodiment of the present invention, a frequency range of at least one octave is detected and processed. Nonetheless, in still other preferred embodiments, the processing may be directed to a single frequency or narrow range of frequencies of less than one-third of an octave. In other alternative embodiments, at least one acoustic sensor is of a directional type while at least one other of the acoustic sensors is of an omnidirectional type. In still other embodiments based on more than two sensors, two or more sensors may be omnidirectional and/or two or more may be of a directional type.

Many other further embodiments of the present invention are envisioned. One further embodiment includes: detecting acoustic excitation with a number of acoustic sensors that provide a number of sensor signals; establishing a set of frequency components for each of the sensor signals; and determining an output signal representative of the acoustic excitation from a designated direction. This determination includes weighting the set of frequency components for each of the sensor signals to reduce variance of the output signal and provide a predefined gain of the acoustic excitation from the designated direction.

For other alternative embodiments, directional sensors may be utilized to detect a characteristic different than acoustic excitation or sound, and correspondingly extract such characteristic from noise and/or one of several sources to which the directional sensors are exposed. In one such example, the characteristic is visible light, ultraviolet light, and/or infrared radiation detectable by two or more optical sensors that have directional properties. A change in signal amplitude occurs as a source of the signal is moved with respect to the optical sensors, and an adaptive beamforming algorithm is utilized to extract a target source signal amidst other interfering signal sources. For this system, a desired source can be selected relative to a reference axis such as axis AZ. In still other embodiments, directional antennas with adaptive processing of radar returns or communication signals can be utilized.

Another embodiment includes a number of acoustic sensors in the presence of multiple acoustic sources that provide a corresponding number of sensor signals. A selected one of the acoustic sources is monitored. An output signal representative of the selected one of the acoustic sources is generated. This output signal is a weighted combination of the sensor signals that is calculated to minimize variance of the output signal.

A still further embodiment includes: operating a voice input device including a number of acoustic sensors that provide a corresponding number of sensor signals; determining a set of frequency components for each of the sensor signals; and generating an output signal representative of acoustic excitation from a designated direction. This output signal is a weighted combination of the set of frequency components for each of the sensor signals calculated to minimize variance of the output signal.

Yet a further embodiment includes an acoustic sensor array operable to detect acoustic excitation that includes two or more acoustic sensors each operable to provide a respective one of a number of sensor signals. Also included is a processor to determine a set of frequency components for each of the sensor signals and generate an output signal representative of the acoustic excitation from a designated direction. This output signal is calculated from a weighted combination of the set of frequency components for each of the sensor signals to reduce variance of the output signal subject to a gain constraint for the acoustic excitation from the designated direction.

A further embodiment includes: detecting acoustic excitation with a number of acoustic sensors that provide a corresponding number of signals; establishing a number of signal transform components for each of these signals; and determining an output signal representative of acoustic excitation from a designated direction. The signal transform components can be of the frequency domain type. Alternatively or additionally, a determination of the output signal can include weighting the components to reduce variance of the output signal and provide a predefined gain of the acoustic excitation from the designated direction.

In yet another embodiment, a system includes a number of acoustic sensors. These sensors provide a corresponding number of sensor signals. A direction is selected to monitor for acoustic excitation with the hearing aid. A set of signal transform components for each of the sensor signals is determined and a number of weight values are calculated as a function of a correlation of these components, an adjustment factor, and the selected direction. The signal transform components are weighted with the weight values to provide an output signal representative of the acoustic excitation emanating from the direction. The adjustment factor can be directed to correlation length or a beamwidth control parameter just to name a few examples.

For a further embodiment, a system includes a number of acoustic sensors to provide a corresponding number of sensor signals. A set of signal transform components are provided for each of the sensor signals and a number of weight values are calculated as a function of a correlation of the transform components for each of a number of different frequencies. This calculation includes applying a first beamwidth control value for a first one of the frequencies and a second beamwidth control value for a second one of the frequencies that is different than the first value. The signal transform components are weighted with the weight values to provide an output signal.

For another embodiment, acoustic sensors provide corresponding signals that are represented by a plurality of signal transform components. A first set of weight values are calculated as a function of a first correlation of a first number of these components that correspond to a first correlation length. A second set of weight values are calculated as a function of a second correlation of a second number of these components that correspond to a second correlation length different than the first correlation length. An output signal is generated as a function of the first and second weight values.

In another embodiment, acoustic excitation is detected with a number of sensors that provide a corresponding number of sensor signals. A set of signal transform components is determined for each of these signals. At least one acoustic source is localized as a function of the transform components. In one form of this embodiment, the location of one or more acoustic sources can be tracked relative to a reference. Alternatively or additionally, an output signal can be provided as a function of the location of the acoustic source determined by localization and/or tracking, and a correlation of the transform components.

In a further embodiment, a hearing aid device includes a number of sensors each responsive to detected sound to provide a corresponding number of sound representative sensor signals. The sensors each have a directional response pattern with a maximum response direction and a minimum response direction that differ in sound response level by at least 3 decibels at a selected frequency. A first axis coincident with the maximum response direction of a first one of the sensors is positioned to intersect a second axis coincident with the maximum response direction of a second one of the sensors at an angle in a range of about 10 degrees through about 180 degrees. In one form, the first one of the sensors is separated from the second one of the sensors by less than about two centimeters, and/or are of a matched cardioid, hypercardioid, supercardioid, or figure-8 type. Alternatively or additionally, the device includes integrated circuitry operable to perform an adaptive beamformer routine as a function of amplitude of the sensor signals and an output device operable to provide an output representative of sound emanating from a direction selected in relation to position of the hearing aid device.

It is contemplated that various signal flow operators, converters, functional blocks, generators, units, stages, processes, and techniques may be altered, rearranged, substituted, deleted, duplicated, combined or added as would occur to those skilled in the art without departing from the spirit of the present inventions. It should be understood that the operations of any routine, procedure, or variant thereof can be executed in parallel, in a pipeline manner, in a specific sequence, as a combination of these appropriate to the interdependence of such operations on one another, or as would otherwise occur to those skilled in the art. By way of nonlimiting example, A/D conversion, D/A conversion, FFT generation, and FFT inversion can typically be performed as other operations are being executed. These other operations could be directed to processing of previously stored A/D or signal transform components, just to name a few possibilities. In another nonlimiting example, the calculation of weights based on the current input signal can at least overlap the application of previously determined weights to a signal about to be output.

Any theory, mechanism of operation, proof, or finding stated herein is meant to further enhance understanding of the present invention and is not intended to make the present invention in any way dependent upon such theory, mechanism of operation, proof, or finding. The following patents, patent applications, and publications are hereby incorporated by reference each in its entirety: U.S. Pat. No. 5,473,701; U.S. Pat. No. 5,511,128; U.S. Pat. No. 6,154,552; U.S. Pat. No. 6,222,927 B1; U.S. patent application Ser. No. 09/568,430; U.S. patent application Ser. No. 09/568,435; U.S. patent application Ser. No. 09/805,233; International Patent Application Number PCT/US01/15047; International Patent Application Number PCT/US01/14945; International Patent Application Number PCT/US99/26965; Banks, D. "Localization and Separation of Simultaneous Voices with Two Microphones" IEE Proceedings I 140, 229-234 (1992); Frost, O. L. "An Algorithm for Linearly Constrained Adaptive Array Processing" Proceedings of IEEE 60 (8), 926-935 (1972); and Griffiths, L. J. and Jim, C. W. "An Alternative Approach to Linearly Constrained Adaptive Beamforming" IEEE Transactions on Antennas and Propagation AP-30(1), 27-34 (1982). While the invention has been illustrated and described in detail in the drawings and foregoing description, the same is to be considered as illustrative and not restrictive in character, it being understood that only the selected embodiments have been shown and described and that all changes, modifications and equivalents that come within the spirit of the invention as defined herein or by the following claims are desired to be protected.

What is claimed is:

1. An sound processing apparatus, comprising:

a hearing aid input arrangement including a number of sensors each responsive to detected sound to provide a corresponding number of sensor signals, the sensors each having a directional response pattern with a maximum response direction and a minimum response direction that differ in sound response level by at least 3 decibels at a selected frequency, a first axis coincident with the maximum response direction of a first one of the sensors being positioned to intersect a second axis coincident with the maximum response direction of a second one of the sensors at an angle in a range of about 10 degrees through about 180 degrees; and a hearing aid processor operable to execute an adaptive beamformer routine with the sensor signals and generate an output signal representative of sound emanating from a selected source.

2. The sound processing apparatus of claim 1, wherein the sensors are a pair of matched microphones and the directional response pattern is of a cardioid, hypercardioid, supercardioid, or figure-8 type.

3. The sound processing apparatus of claim 1, wherein the angle is about 90 degrees.

4. The sound processing apparatus of claim 1, wherein the angle is about 180 degrees with the maximum response direction of the first one of the sensors being generally opposite the maximum response direction of the second one of the sensors.

5. The sound processing apparatus of claim 1, further comprising a reference axis, the routine being operable to determine the selected source relative to the reference axis.

6. The sound processing apparatus of claim 5, wherein the reference axis generally bisects the angle.

7. The sound processing apparatus of claim 1, further comprising one or more analog-to-digital converters and at least one digital-to-analog converter, the routine being operable to transform input data from a time domain form to a frequency domain form, and is further operable to adaptively change a number of signal weights for each of a number of different frequency components to provide the output signal.

8. The sound processing apparatus of claim 1, wherein the routine is executable to adjust a correlation factor to control beamwidth as a function of frequency.

9. A sound processing method, comprising:

providing a number of sensors each responsive to detected sound to provide a corresponding number of sensor signals, the sensors each having a directional response pattern with a maximum response direction and a minimum response direction that differ in sound response level by at least 3 dB at a selected frequency, a first axis coincident with the maximum response direction of a first one of the sensors being positioned to intersect a second axis coincident with the maximum response direction of a second one of the sensors at an angle in a range of about 10 degrees through about 180 degrees;

processing signals from each of the sensors with a hearing aid as a function of a number of signal weights adaptively recalculated from time-to-time; and providing an output of the hearing aid based on said processing, the output being representative of sound emanating from a selected source.

10. The sound processing method of claim 9, wherein the angle is approximately 180 degrees.

11. The sound processing method of claim 10, wherein the maximum response direction of the first one of the sensors and the maximum response direction of the second one of the sensors are approximately opposite one another.

12. The sound processing method of claim 9, wherein the angle is between about 20 degrees and about 160 degrees.

13. The sound processing method of claim 9, wherein said processing includes determining the selected sound source position relative to a reference axis that approximately bisects the angle.

14. The sound processing method of claim 9, wherein said processing is further performed as a function of a number of different frequencies.

15. The sound processing method of claim 9, which includes varying beamwidth as a function of the frequencies.

16. The sound processing method of claim 9, which includes adaptively changing a correlation length.

17. The sound processing method of claim 9, wherein the number of sensors is two or more, and the first one of the sensors is approximately collocated with the second one of the sensors to reduce response time difference therebetween.

18. An sound processing apparatus, comprising:

a sound input arrangement including a number of microphones oriented in relation to a reference axis and operable to provide a number of microphone signals representative of sound, the microphones each having a directional sound response pattern with a maximum response direction, the microphones being positioned in a predefined positional relationship relative to one another with a separation distance of less than two centimeters to reduce a difference in time of response between the microphones for sound emanating from a source closer to one of the microphones than another of the microphones; and a processor responsive to the microphones to define an adaptive beamformer to generate an output signal as a function of a number of signal weights for each of a number of different frequencies, the signal weights being adaptively recalculated with the processor from time-to-time based on an amplitude difference between the microphone signals for each of the different frequencies.

19. The sound processing apparatus of claim 18, wherein the processor includes means for adjusting beamwidth in accordance with sound interference level.

20. A sound processing method, comprising:

providing a number of sensors each responsive to detected sound to provide a corresponding number of sensor signals, the sensors each having a directional response pattern with a maximum response direction and a minimum response direction that differ in sound response level by at least 3 dB at a selected frequency, a first axis coincident with the maximum response direction of a first one of the sensors being positioned to intersect a second axis coincident with the maximum response direction of a second one of the sensors at an angle in a range of about 10 degrees through about 180 degrees;

processing the sensor signals as a function of a number of signal weights adaptively recalculated from time-to-time to define an adaptive beamformer;

providing an output based on said processing, the output being representative of sound emanating from a selected source;

determining a level of interference; and adjusting beamwidth of the beamformer in accordance with the level of interference.

21. The sound processing method of claim 20, wherein the angle is approximately 180 degrees.

22. The sound processing method of claim 20, wherein the angle is between about 20 degrees and about 160 degrees.

23. The sound processing method of claim 20, wherein said processing includes determining the selected sound source position relative to a reference axis that approximately bisects the angle.

24. The sound processing method of claim 20, which includes varying beamwidth as a function of the frequencies.

25. The sound processing method of claim 20, which includes adaptively changing a correlation length.

26. The sound processing method of claim 20, wherein the first one of the sensors is approximately collocated with the second one of the sensors to reduce response time difference therebetween for sound emanating from a source closer to one of the sensors than another of the sensors, and the signal weights are determined in accordance with an amplitude difference between the sensor signals for each of a number of different frequencies.

27. The sound processing apparatus of claim 9, which includes:

positioning the sensors in a predefined positional relationship relative to one another with a separation distance of less than two centimeters to reduce a difference in time of response between the sensors for sound emanating from a source closer to one of the microphones than another of the microphones; and wherein the processing includes determining the signal weights as a function of an amplitude difference between the signals for each of a number of different frequencies in the frequency domain.

28. A sound processing apparatus, comprising:

an input arrangement including a number of sensors each responsive to detected sound to provide a corresponding number of sensor signals, the sensors each having a directional response pattern with a maximum response direction and a minimum response direction that differ in sound response level by at least 3 decibels at a selected frequency, a first axis coincident with the maximum response direction of a first one of the sensors being positioned to intersect a second axis coincident with the maximum response direction of a second one of the sensors at an angle in a range of about 10 degrees through about 180 degrees; and a processor operable to define an adaptive beamformer with the sensor signals and generate an output signal representative of sound emanating from a selected source, the processor being responsive to a sound interference level to adjust beamwidth of the beamformer.

* * * * *